US010736440B2

(12) United States Patent
Iyengar et al.

(10) Patent No.: US 10,736,440 B2
(45) Date of Patent: Aug. 11, 2020

(54) MODULAR REFRIGERATION SYSTEMS

(71) Applicant: KYSOR WARREN EPTA US CORPORATION, Columbus, GA (US)

(72) Inventors: Ajay Iyengar, Johns Creek, GA (US); Robert Paul DelVentura, Snellville, GA (US); Oivind Brockmeier, Medford, MA (US); Todd A. Hoff, Suwanee, GA (US); James Kenneth Knudsen, Catalan, GA (US); Richard Henry Kon, Wakefield, RI (US); Timothy Proulx, Nashua, NH (US); William C. Stewart, Ipswich, MA (US)

(73) Assignee: KYSOR WARREN EPTA US CORPORATION, Columbus, GA (US)

( * ) Notice: Subject to any disclaimer, the term of this patent is extended or adjusted under 35 U.S.C. 154(b) by 330 days.

(21) Appl. No.: 14/511,320

(22) Filed: Oct. 10, 2014

(65) Prior Publication Data

US 2015/0101359 A1 Apr. 16, 2015

Related U.S. Application Data

(60) Provisional application No. 61/889,092, filed on Oct. 10, 2013.

(51) Int. Cl.
*A47F 3/04* (2006.01)
*A47F 5/10* (2006.01)
(Continued)

(52) U.S. Cl.
CPC ..... *A47F 3/0482* (2013.01); *A47B 57/06* (2013.01); *A47F 3/0408* (2013.01);
(Continued)

(58) Field of Classification Search
CPC .... A47F 3/0482; A47F 3/0408; A47F 3/0443; A47F 3/0486; A47F 3/0491;
(Continued)

(56) References Cited

U.S. PATENT DOCUMENTS 2,625,806 A * 1/1953 Kennedy ..... A47F 3/0495 211/127.1
3,090,211 A * 5/1963 Barroero ..... F25D 25/028 454/193
(Continued)

FOREIGN PATENT DOCUMENTS

DE 10 2006 020717 B3 7/2007
DE 102006020717 B3 * 7/2007 ..... A47F 3/0439
(Continued)

OTHER PUBLICATIONS

Thermoplastic Polyurethanes—Versatile and Durable for Today's and Tomorrow's Products, Roger Huarng and Stephane Morin, Prospector, Dec. 2010.*

*Primary Examiner* — Marc E Norman
*Assistant Examiner* — Schyler S Sanks
(74) *Attorney, Agent, or Firm* — Meunier Carlin & Curfman LLC

(57) ABSTRACT

The present application provides a refrigerated merchandising case. The refrigerated merchandising case may include a refrigerated product area, a rear panel with a roller channel and a number of support apertures, and a number of shelves with a roller and a number of attachment prongs. The shelves may maneuver along the rear panel via the roller within roller channel and attach via the attachment prongs and the support apertures.

14 Claims, 23 Drawing Sheets

(51) Int. Cl.
*A47B 57/06* (2006.01)
*A47B 96/02* (2006.01)
*A47B 96/06* (2006.01)

(52) U.S. Cl.
CPC ..... *A47F 3/0443* (2013.01); *A47F 3/0486* (2013.01); *A47F 3/0491* (2013.01); *A47F 5/103* (2013.01); *A47B 96/025* (2013.01); *A47B 96/06* (2013.01); *A47F 3/0495* (2013.01)

(58) Field of Classification Search
CPC ..... A47F 3/0447; A47F 3/06; A47F 5/103; A47F 3/0495; A47F 2003/046
USPC ..... 312/116, 408, 406; 62/251; 108/108
See application file for complete search history.

(56) References Cited

U.S. PATENT DOCUMENTS 4,347,710 A * 9/1982 Ibrahim ..... F25D 21/125 62/155
4,630,451 A 12/1986 Kishimoto
4,805,863 A * 2/1989 Armstrong ..... A47B 96/061 108/108
5,517,826 A * 5/1996 Duffy ..... A47F 3/0443 312/116
7,511,505 B1 * 3/2009 Bailey ..... F25D 23/006 324/511
2003/0196567 A1 * 10/2003 Norton ..... B61D 17/005 105/396
2004/0060884 A1 * 4/2004 Nook ..... A47F 5/0018 211/189
2005/0126196 A1 * 6/2005 Grassmuck ..... A47F 3/0482 62/251
2006/0240761 A1 10/2006 Yamaguchi
2008/0042529 A1 * 2/2008 Siemon ..... A47F 3/06 312/114
2009/0044553 A1 * 2/2009 Tilley ..... A47F 3/0443 62/251
2009/0165342 A1 * 7/2009 Chasmer ..... A47F 5/0846 40/1
2010/0018227 A1 * 1/2010 Daddis, Jr. ..... A47F 3/0408 62/89
2010/0181883 A1 7/2010 Kim et al.
2011/0303087 A1 * 12/2011 Sadler ..... A23B 7/152 95/144
2012/0105424 A1 5/2012 Lee et al.
2012/0187060 A1 * 7/2012 Candos ..... A47F 5/0838 211/59.2
2014/0263739 A1 * 9/2014 LaMontagne ..... A47B 3/04 239/302

FOREIGN PATENT DOCUMENTS

EP 1 650 679 A1 3/2006
EP 1640679 A1 3/2006
WO 2008/117911 A1 10/2008
WO 2012/057457 A1 5/2012

* cited by examiner

MODULAR REFRIGERATION SYSTEMS

RELATED APPLICATIONS

The present application is a non-provisional application claiming priority to commonly-owned U.S. Provisional Application Ser. No. 61/889,092, filed on Oct. 10, 2013. U.S. Provisional Application Ser. No. 61/889,092 is incorporated by reference herein in full.

TECHNICAL FIELD

The present application and the resultant patent relate generally to modular refrigeration systems and more particularly relate to refrigerated merchandising cases such as multi-decks, reach-ins, and the like assembled with modular components for increased flexibility.

BACKGROUND OF THE INVENTION

The modern supermarket may have any number of different types of refrigerated merchandising cases to store and display different types of frozen and refrigerated products. These refrigerated merchandising cases may include multi-deck cases, single-deck cases, island cases, service cases, reach-in cases, and the like. Each of these different case types typically includes complicated refrigeration components such as the associated evaporator coils, plumbing, fans, and controls as well as shelves, lighting, and the like. The overall case must be arranged so as to promote consumer interest in the products therein while adequately and efficiently refrigerating those products.

Although each of these different cases may share similar components, many refrigerated merchandising cases may be assembled in an almost customized manner. As a result, many variations may be found among the cases of even the same manufacturer. These variations may lead to difficulties in installation and in ongoing maintenance and repair.

There is therefore a desire for a more standardized approach to refrigerated merchandising case design and assembly. Specifically, the use of modular components for the various types of refrigerated merchandising cases may simplify assembly and maintenance while also giving the end user more configuration and display options.

SUMMARY OF THE INVENTION

The present application and the resultant patent thus provide a refrigerated merchandising case. The refrigerated merchandising case may include a refrigerated product area, a rear panel with a roller channel and a number of support apertures, and a number of shelves with a roller and a number of attachment prongs. The shelves may maneuver along the rear panel via the roller within roller channel and attach via the attachment prongs and the support apertures.

These and other features and advantages of the present application and the resultant patent will become apparent to one of ordinary skill in the art upon review of the following detailed description when taken in conjunction with the several drawings and the appended claims.

DETAILED DESCRIPTION

Figure 1:
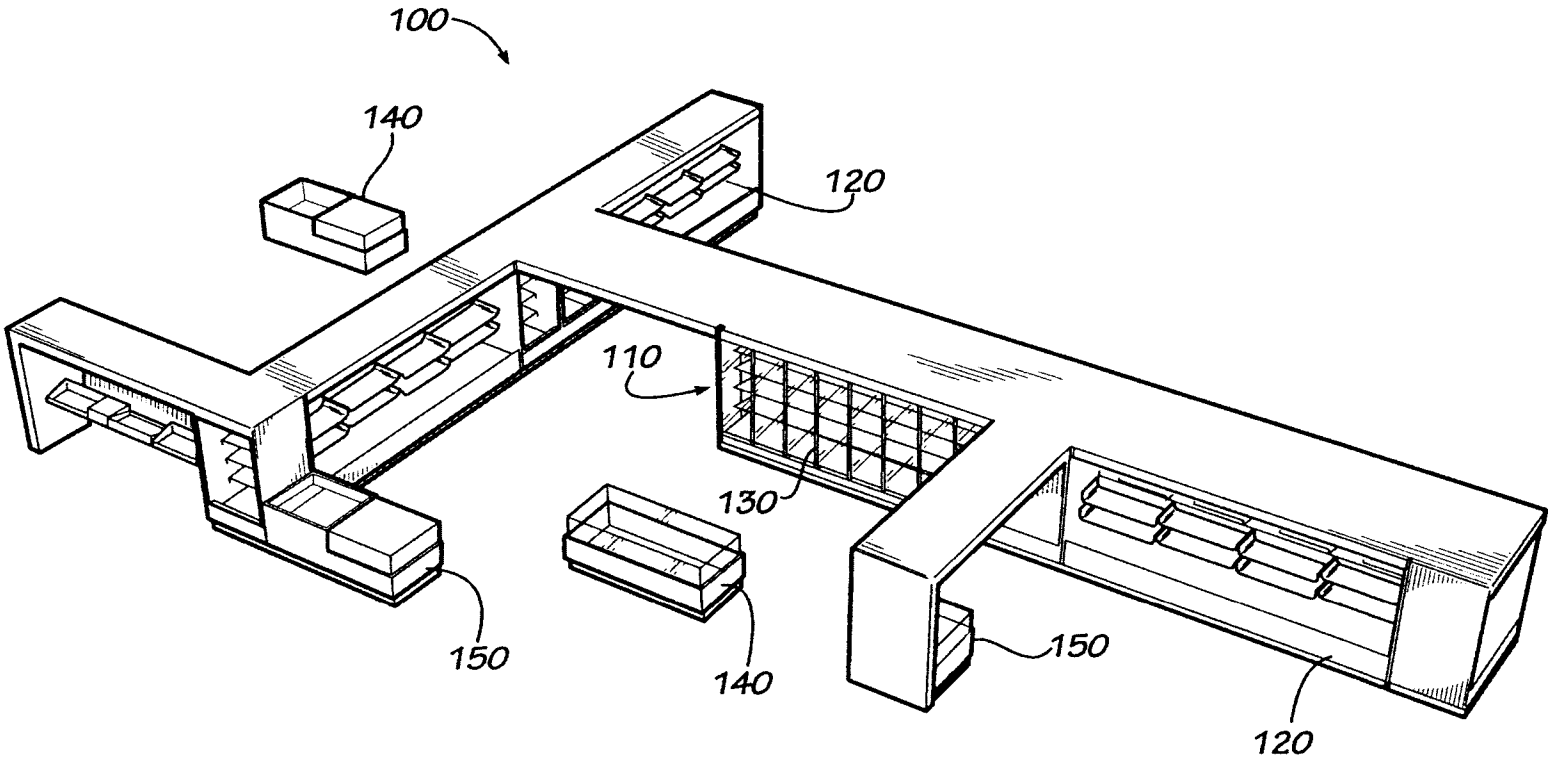
FIG. 1 is a perspective view of an example of a supermarket as may be described herein.
Figure 2:
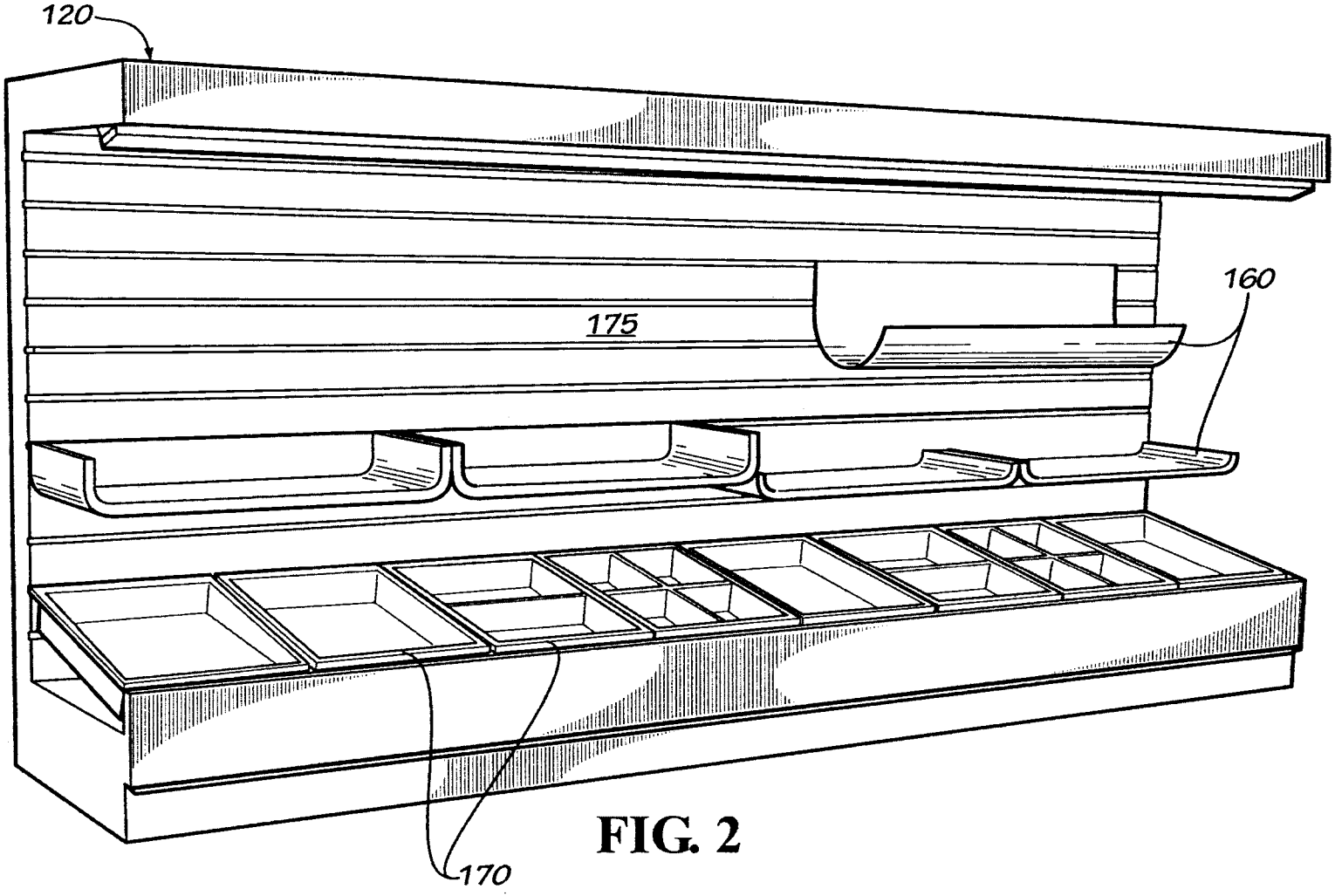
FIG. 2 is a perspective view of a multi-deck refrigerated merchandising case as may be described herein.
Figure 3:
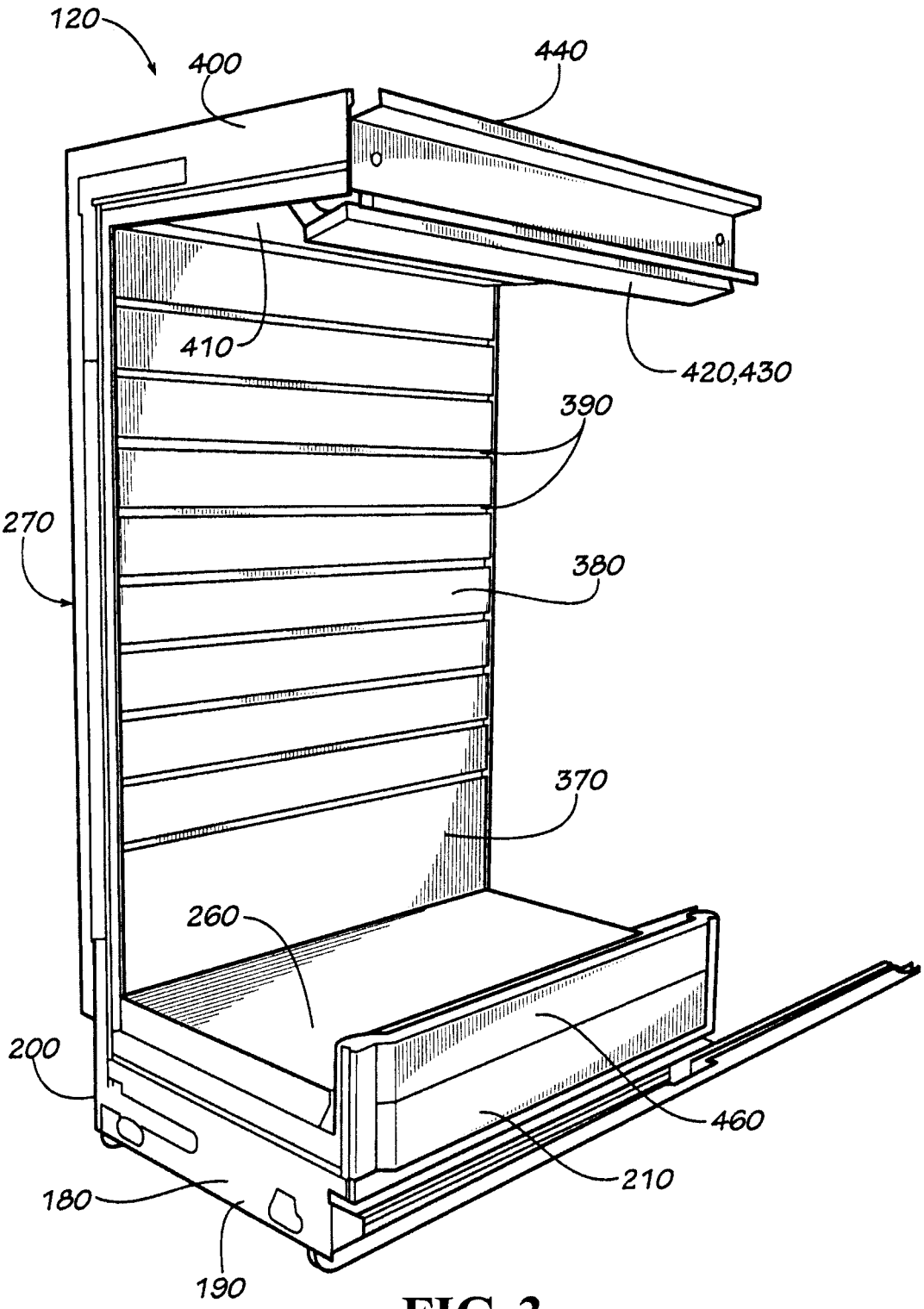
FIG. 3 is a perspective view of the components of the multi-deck refrigerated merchandising case of FIG. 2.
Figure 4:
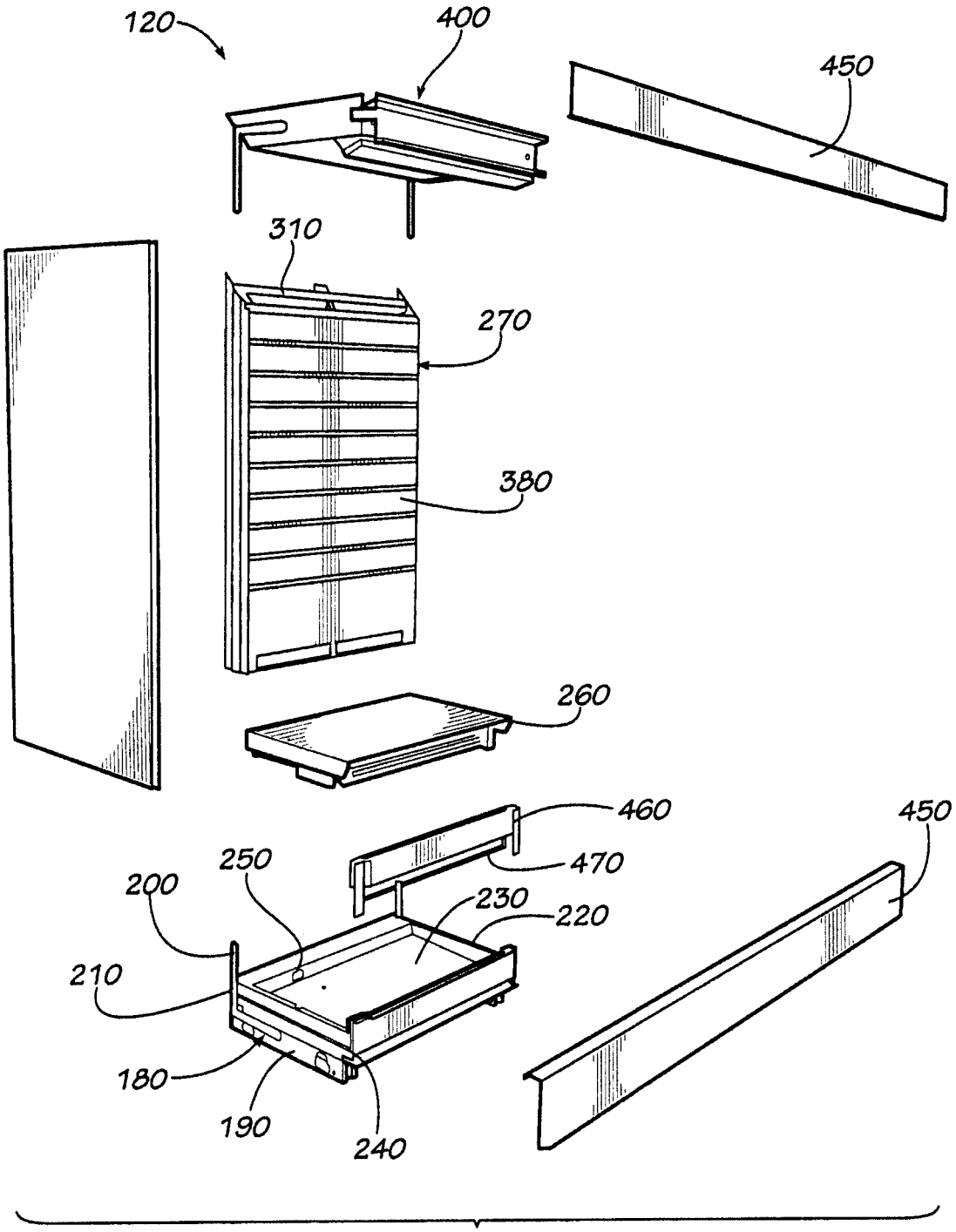
FIG. 4 is an exploded view of the components of the multi-deck refrigerated merchandising case of FIG. 2.
Figure 5:
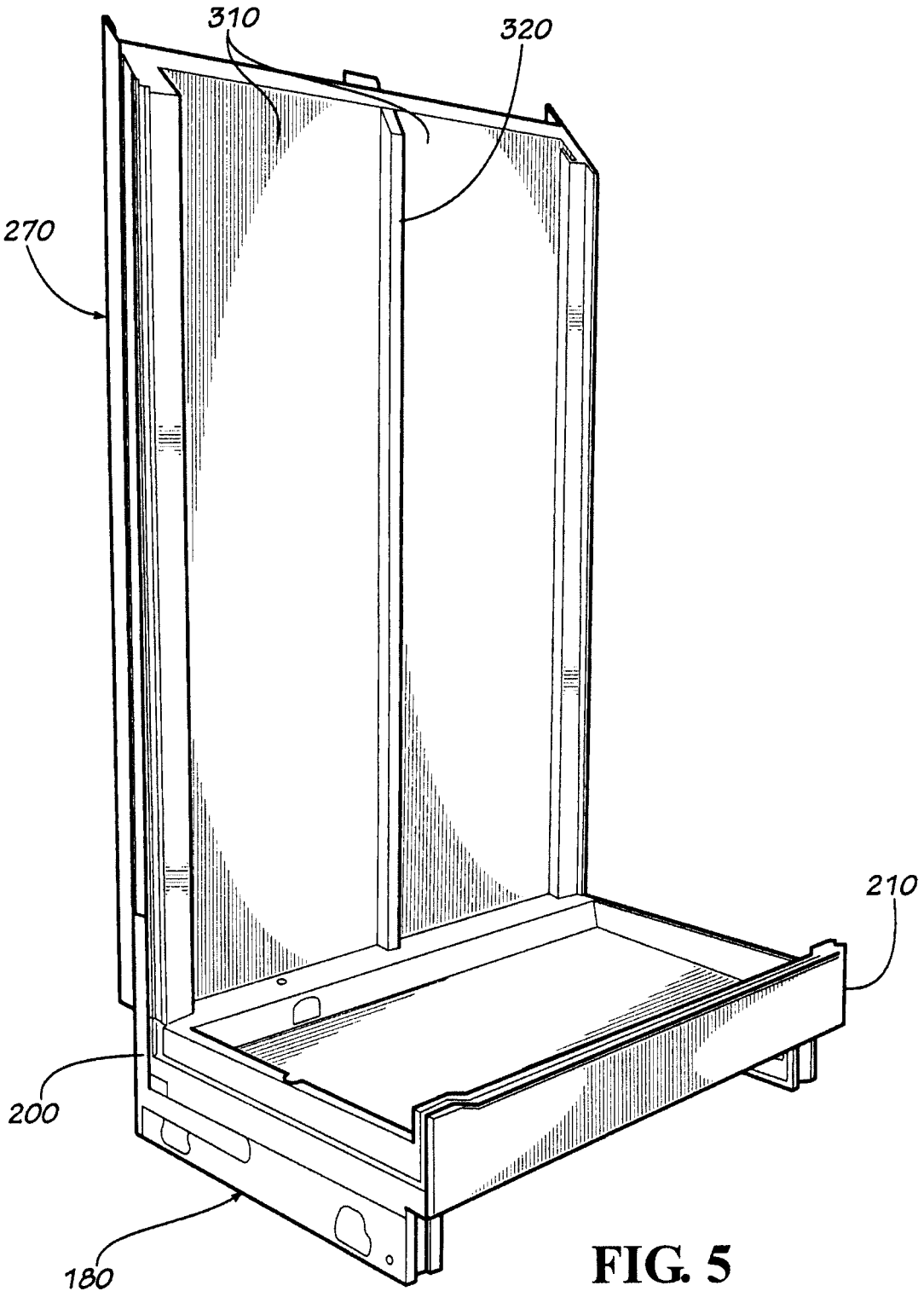
FIG. 5 is a perspective view of the rear panel and the tub of the multi-deck refrigerated merchandising case of FIG. 2.

Referring now to the drawings, in which like numerals refer to like elements throughout the several views, FIG. 1 shows an example of a supermarket 100 as may be described herein. As described above, the supermarket 100 may include a number of refrigerated merchandising cases 110. A number of the refrigerated merchandising cases 110 may be in communication with a common refrigeration system (not shown). In such a common refrigeration system, each refrigerated merchandising case 110 may have one or more evaporator coils therein with the other components of the common refrigeration system, such as the compressor, the condenser, and the like positioned elsewhere. In this example, the supermarket 100 may include one or more multi-deck refrigerated merchandising cases 120 and one or more reach-in refrigerated merchandising cases 130. The supermarket 100 also may have a number of island refrigerated merchandising cases 140 and single-deck refrigerated merchandising cases 150. Other types of refrigerated merchandising cases 110, such as service cases and the like also may be used herein. Any number of the refrigerated merchandising cases 110 may be used herein in any size, shape, or configuration.

FIGS. 2-6 show the components of an example of the multi-deck refrigerated merchandising case 120 as may be described herein. Generally described, the multi-deck merchandising case 120 may be unenclosed and may refrigerate the products therein via an air curtain type effect. The multi-deck refrigerated merchandising case 120 may include any number of product shelves 160, product bins 170, and or other types of product displays. The product shelves 160 and the product bins 170 may have any size, shape, or configuration. The product shelves 160 and the product bins 170 may have varying configurations based upon the products intended to be positioned therein. The product shelves 160 and the product bins 170 may be positioned within a refrigerated product area 175 with the products therein.

Starting from the ground up, the multi-deck refrigerated merchandising case 120 may include a foundation 180. The foundation 180 may include a number of base rails 190. A pair of gussets 200 may be attached to the case rails 190. The gussets 200 may be largely L-shaped support structures. Other types of support structures may be used herein. The base rails 190 and the gussets 200 may be made out of metals or other types of substantially rigid materials. The foundation 180 may have any size, shape, or configuration.

A lower tub 210 may be positioned on the foundation 180. The lower tub 210 may include a number of injection molded thermoplastic sides 220 positioned on a sheet metal bottom 230. The sides 220 may have a gasket groove 240 running about a perimeter thereof. The rear side 220 may include a pass-through 250 for piping, cabling, and the like. The lower tub 210 may have any size, shape, or configuration.

A cooling module 260 may be positioned within the lower tub 210. The cooling module 260 may include one or more evaporator coils, a fan, and other components in communication with a common cooling system as was described above. The cooling module 260 may be a drop-in type device. The cooling module 260 may have any size, shape, or configuration and may have any capacity. The top of the cooling module 260 also may act as a lower deck. Other components and other configurations may be used herein.

A rear panel 270 may be positioned on top of the lower tub 210. The rear panel 270 may be secured to the foundation 180 and the lower tube 210 via the gussets 200 or other types of connections. The rear panel 270 may have a pair of gusset channels 280 formed therein for mating with the gussets 200. The rear panel 270 may be from a pultruded shell 290 with a foam interior 300. The pultruded shell 290 may be made out of a fiber glass material with high strength and relatively low weight. The foam interior may be any type of foam material with good insulating characteristics. Other materials may be used herein. The rear panel may form a number of air plenums 310. The air plenums 310 may have any size, shape, or configuration. The air plenums 310 may be divided by an air plenum spacer 320. The rear panel 270 also may include a number of channels such as a gasket channel 340, a cable channel 350, a panel channel 360, and the like. The rear panel 270 and the components thereof may have any size, shape, or configuration.

An inner lower panel 370 may be positioned within the panel channel 360 of the rear panel 270. The inner lower panel 370 may have a number of inlet openings therein in communication with the air plenums 310 and the cooling module 260. A slat wall 380 also may be positioned within the panel channel 360 of the rear panel 270. The slat wall 380 may be made from a number of roll formed sections. The slat wall 380 may include a number of support channels 390 formed therein for mating with product shelves and the like as will be described in more detail below. The slat wall 380 may have any size, shape, or configuration.

A top panel 400 may be positioned on top of the rear panel 270. The top panel 400 may be secured to the rear panel 270 by a further pair of gussets 200 or other types of connections. The top panel 400 also may have the pultruded shell 290 with the foam interior 300. Other materials also may be used herein. The top panel 400 may have any size, shape, or configuration. A ceiling panel 410 may slide into the top panel 400. The top panel 400 and the ceiling panel 410 may define the air plenums 310 therethrough. The air plenums 310 may end about a honeycomb module 420. The honeycomb module 420 may include a honeycombed structure 430 and the like so as to remove any particulate matter that may be in the airstream therethrough. A soffit module 440 may enclose the top panel 400. The soffit module 440 may be sized for a clipped on fascia 450. The fascia 450 may have any type of design and/or information thereon. Other components and other configurations may be used herein.

The front end of the cooling module 260 also may be enclosed by a riser module 460. The riser module 460 may include the pultruded shell 290 with the foam interior 300. Other materials also may be used herein. The riser module 460 may have any size, shape, or configuration. A riser screen 470 also may be used about the cooling module 260. The clip-on fascia 450 also may be used about the riser module 460. The clip-on fascia 450 may be the same or different. Other components and other configurations may be used herein.

Figure 7:
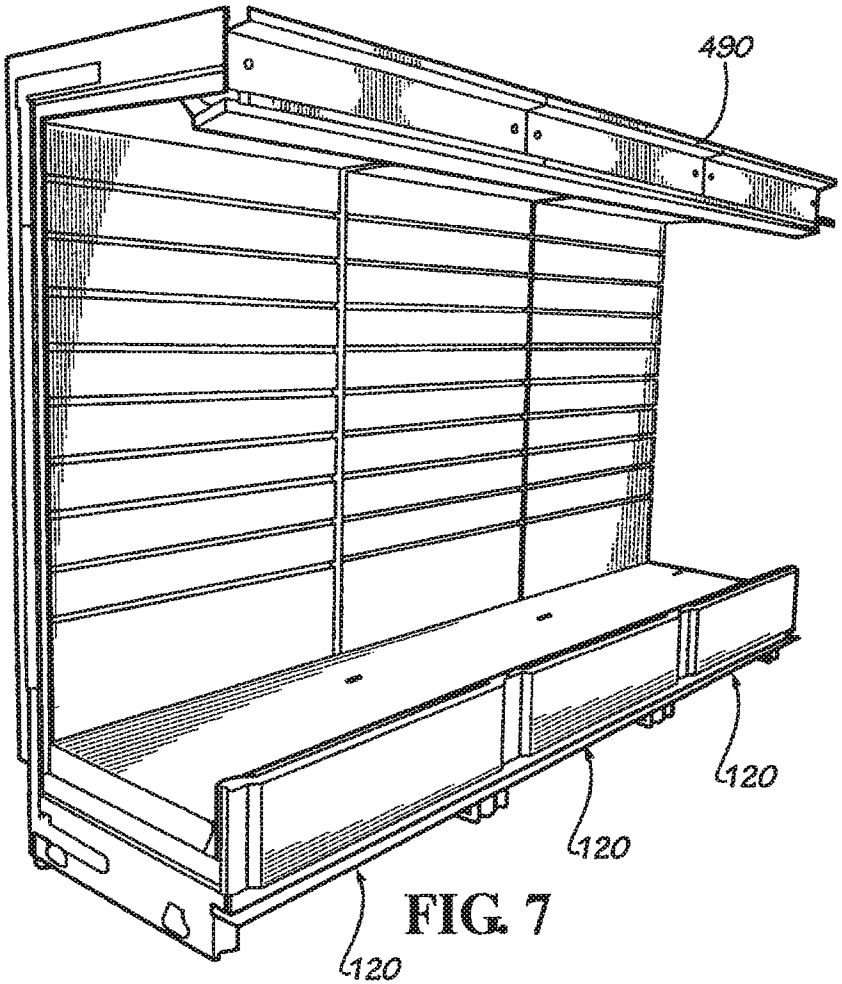
FIG. 7 is a perspective view of a number of multi-deck refrigerated merchandising cases combined as a single unit.
Figure 6:
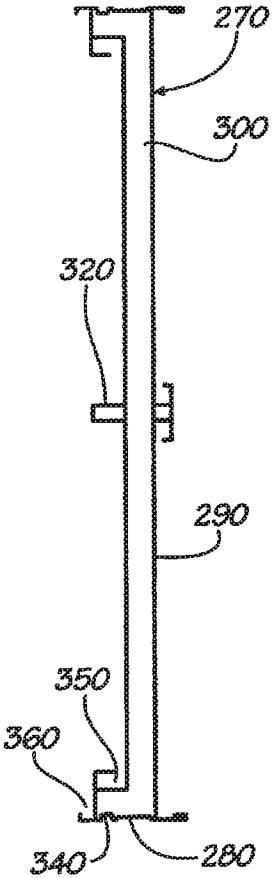
FIG. 6 is a sectional view of the rear panel of FIG. 5.
Figure 8:
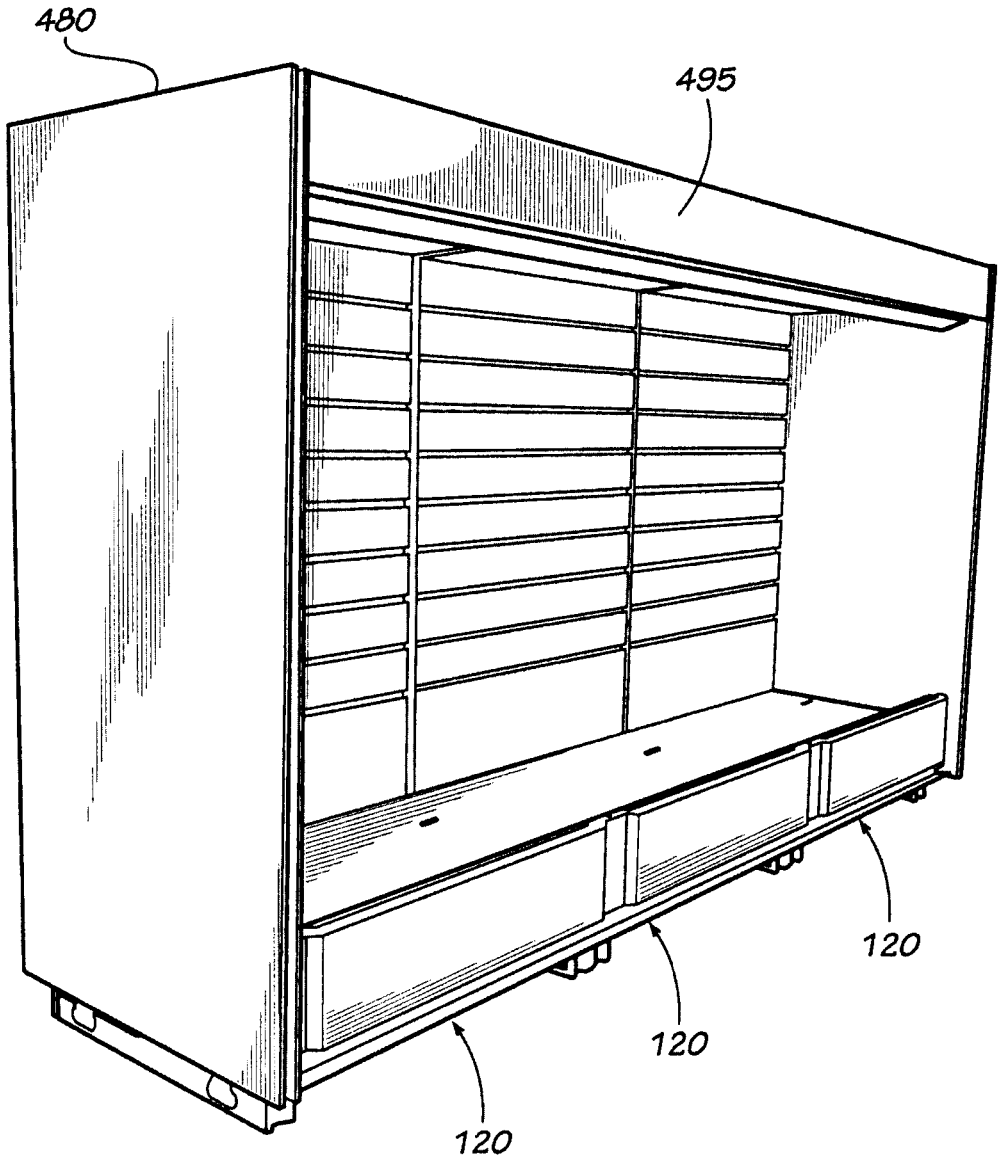
FIG. 8 is a perspective view of a number of multi-deck refrigerated merchandising cases joined together with a side wall.
Figure 9:
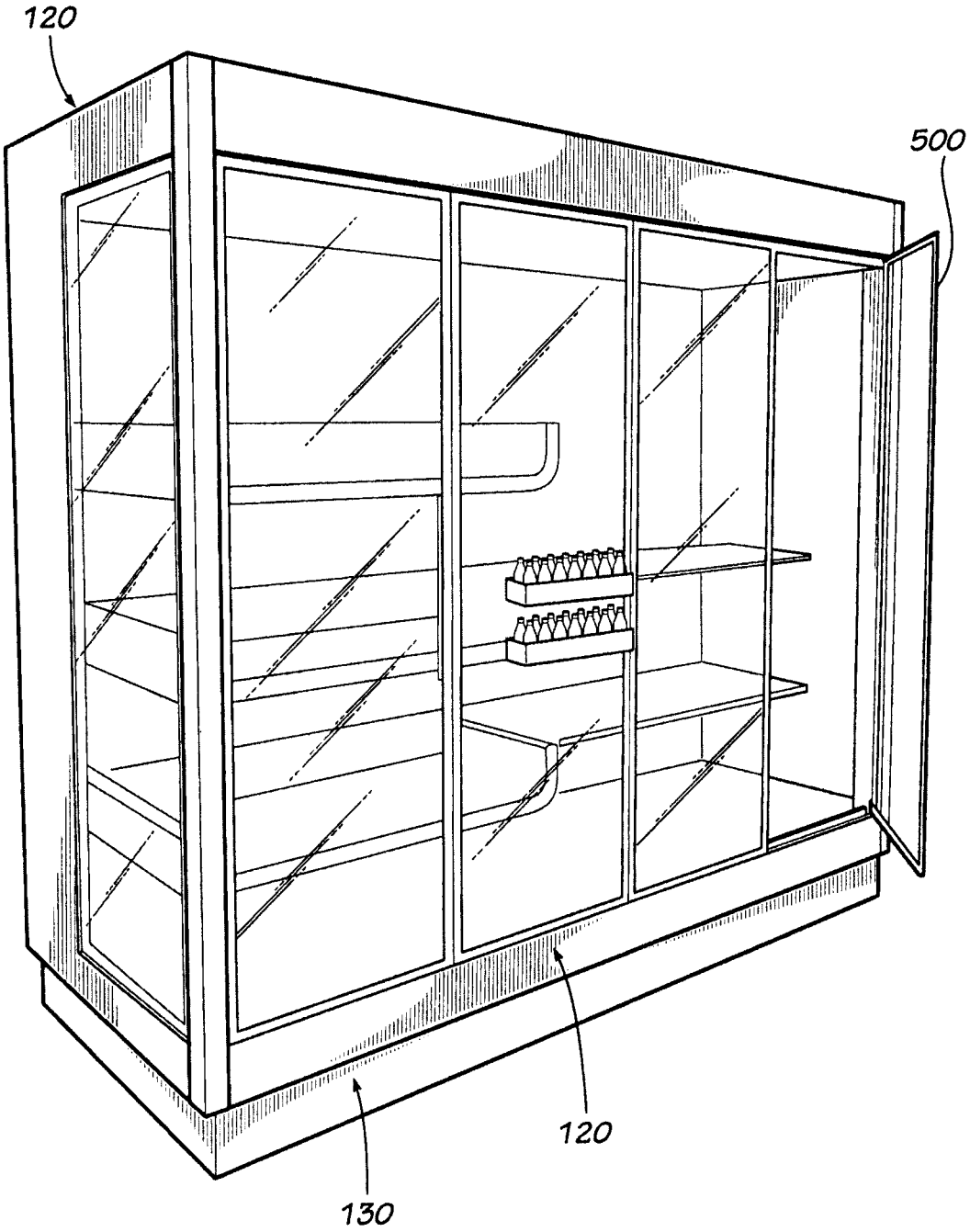
FIG. 9 is a perspective view of an enclosed multi-deck refrigerated merchandising case.
Figures 10A, 10B, 10C, 10D, 10E:
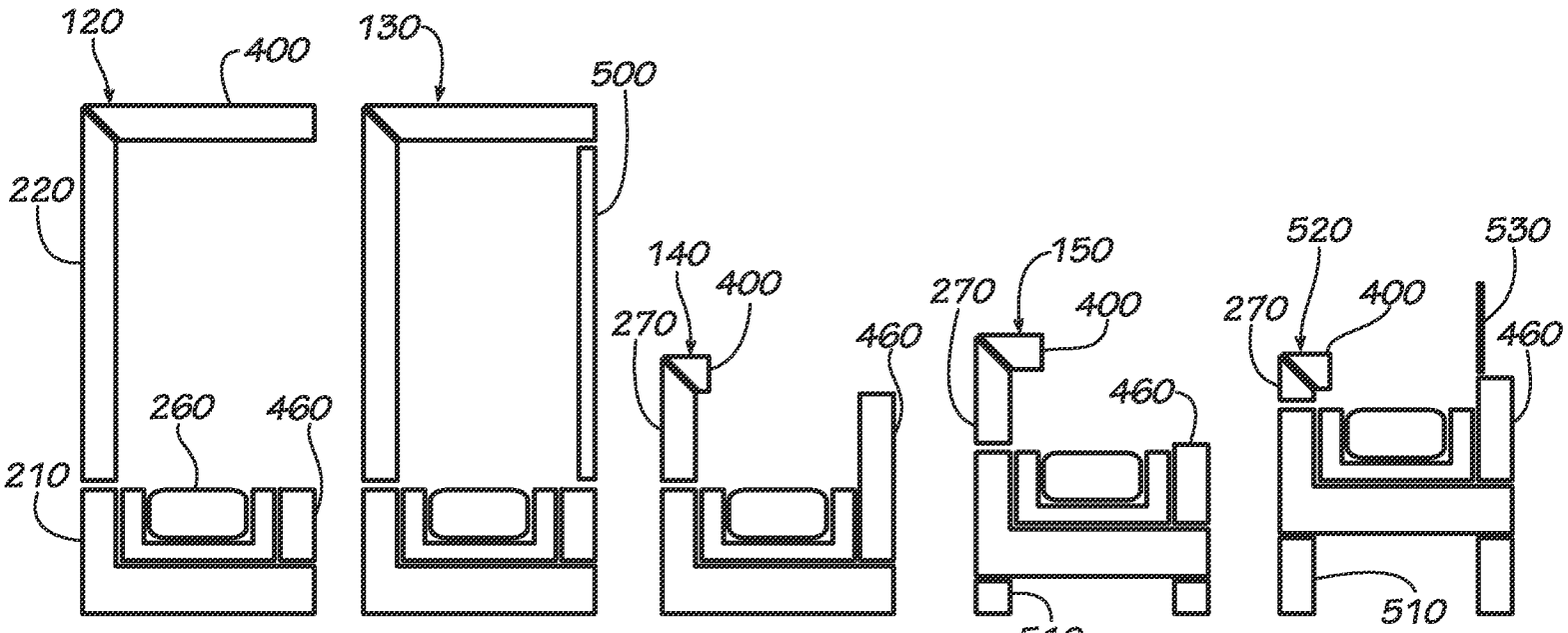
FIG. 10A is a schematic diagram of the components of a multi-deck refrigerated merchandising case.
FIG. 10B is a schematic diagram of the components of a reach-in refrigerated merchandising case.
FIG. 10C is a schematic diagram of the components of an island refrigerated merchandising case.
FIG. 10D is a schematic diagram of the components of a single-deck refrigerated merchandising case.
FIG. 10E is a schematic diagram of the components of a service refrigerated merchandising case.

FIGS. 7 and 8 show a number of the multi-deck refrigerated merchandising cases 120 combined. In such an orientation, an end wall 480 may be used on the outer ends of the outer cases. A common soffit module 490 and a common fascia 495 also may be used so as to give the appearance of a unified configuration. Any number of the multi-deck refrigerated merchandising cases 120 may be combined. FIG. 9 shows a further alternative of the multi-deck refrigerated merchandising cases 120. In this example, the multi-deck refrigerated merchandising case 120 may be configured with a number of outer doors 500 in a configuration of a reach-in refrigerated merchandising case 130. Other components and other configurations may be used herein.

FIGS. 10A-10E show different configurations of refrigerated merchandising cases 110 using the common or modular components therein. For example, each of the configurations may use the lower tub 210 and the cooling module 260 (although cooling modules 260 of different capacities also may be used). The multi-deck refrigerated merchandising case 120 may add the rear panel 270 and the top panel 400. The reach-in refrigerated merchandising case 130 may add the outer door 500. The island refrigerated merchandising case 140 may add a truncated rear panel 270 and a top panel 400 with an elongated riser module 460. The single-deck refrigerated merchandising case 150 may add a base 510 to elevate the case and then may add the truncated rear panel 270 and top panel 400 with the riser module 460. A service merchandising case 520 may include an elongated base 510, an even further truncated rear panel 270 and top panel 400, an elongated riser module 460, and a glass panel 530. Other components and other configurations may be used herein. Any number of combinations of components may be used herein.

Figure 11:
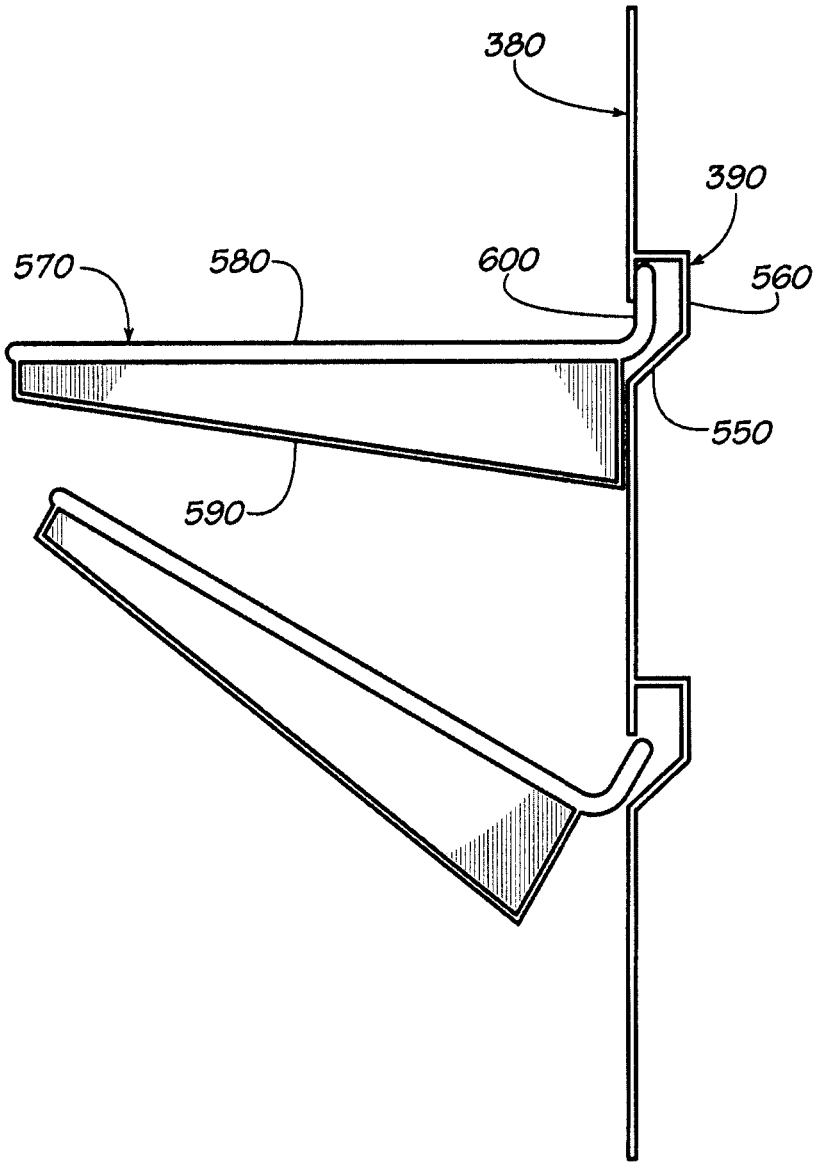
FIG. 11 is a side plan view of a shelf positioned within the rear panel of the multi-deck refrigerated merchandising case.

FIG. 11 shows a configuration of the slat wall 380. The slat wall 380 may include a number of the support channels 390 formed therein. Each channel 390 may include an angled entrance 550 leading to an enclosed end 560. The channels 390 may be used with the product shelves 160. In this example, a product shelf 570 may include a shelf panel 580 supported by an angled support bracket 590. The shelf panel 580 may extend into a mounting flange 600. The mounting flange 600 may be positioned within the angled entrance 550 and then into the enclosed end 560 of the channel 390 of the slat wall 380. The angled support bracket 590 then supports the shelf panel 580 against the slat wall 380. The channels 390 may have any size or shape and may have other configurations. The product shelf 570 may have other sizes, shapes, and configurations. Other components and other configurations may be used herein. The slat wall 380 thus allows differing and changeable configurations of product shelves 570 and the like thereon.

Figure 13:
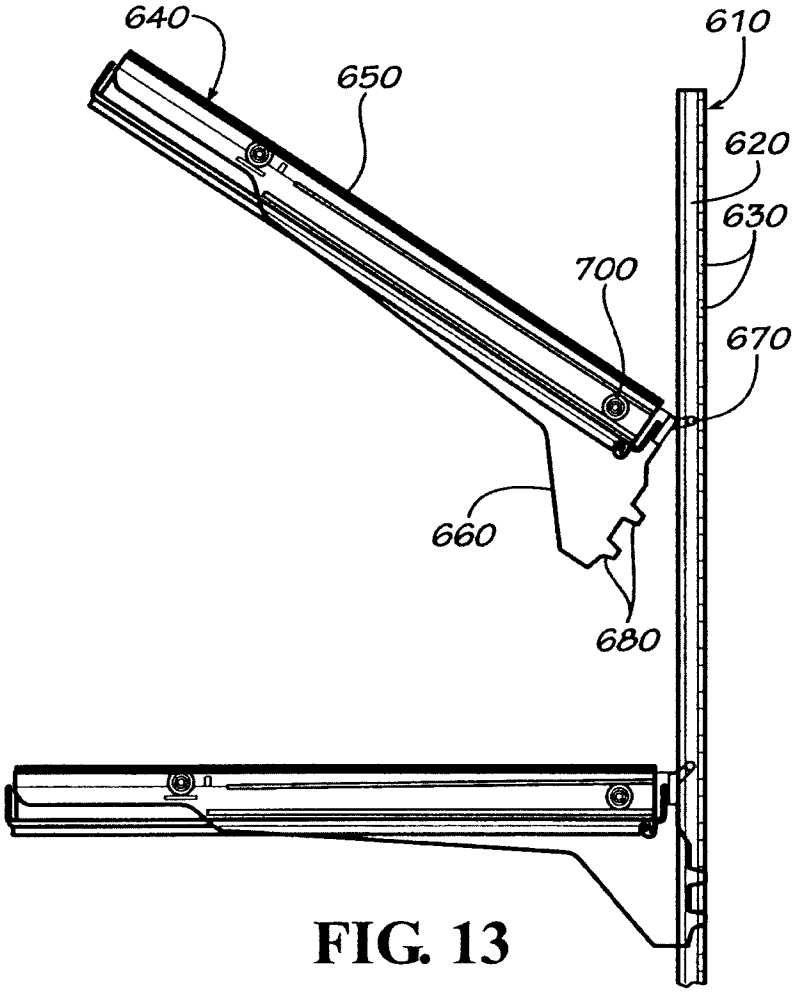
FIG. 13 is a side view of the movable shelf of FIG. 12.
Figure 12:
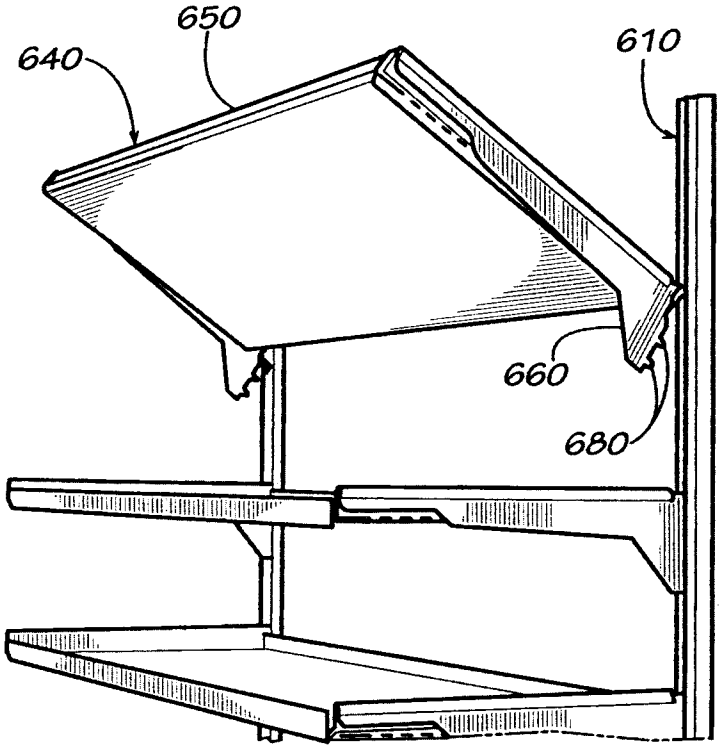
FIG. 12 is a perspective view of a movable shelf as may be described herein.

In addition to the product shelves 160 and product bins 170 positioned about the slat wall 380, other types of shelving may be used herein with the multi-deck refrigerated merchandising cases 120 or any of the refrigerated merchandising cases 110. For example, shelf rails 610 also may be used. As is shown in FIGS. 12 and 13, the shelf rails 610 may include a number of roller channels 620 and support apertures 630. The shelf rails 610 may have any size, shape, or configuration. Alternatively, the channels 390 of the slat wall 380 may be used as the roller channels 620 without the use of the shelf rails 610 and the like. The shelf rails 610 and/or the roller channels 620 may run in a vertical and/or horizontal fashion and/or at any angle therebetween. The shelf rails 610 and/or the channels 620 may be used with a number of product shelves 640. The product shelves 640 may have any size, shape, or configuration. In this example, the product shelves 640 may include a shelf panel 650 and an attachment bracket 660. The attachment bracket 660 may include a roller 670. The roller 670 may be sized to maneuver within the roller channel 620. The attachment bracket 660 also may include a number of attachment prongs 680. The attachment prongs 680 may be sized to fit within the support apertures 630 of the channels 620. The product shelves 640 thus may be maneuverable in any direction as the roller 670 maneuvers within the roller channels 620. The product shelf 640 then may be secured in place by positioning the attachment prong 680 within the support apertures 630. Other components and other configurations also may be used herein.

Figure 14:
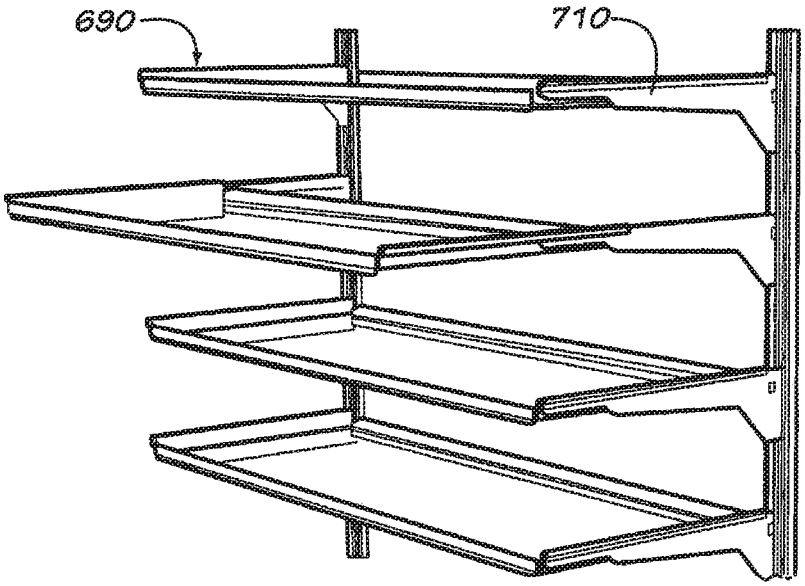
FIG. 14 is a perspective view of a slide out shelf as may be described herein.
Figure 15:
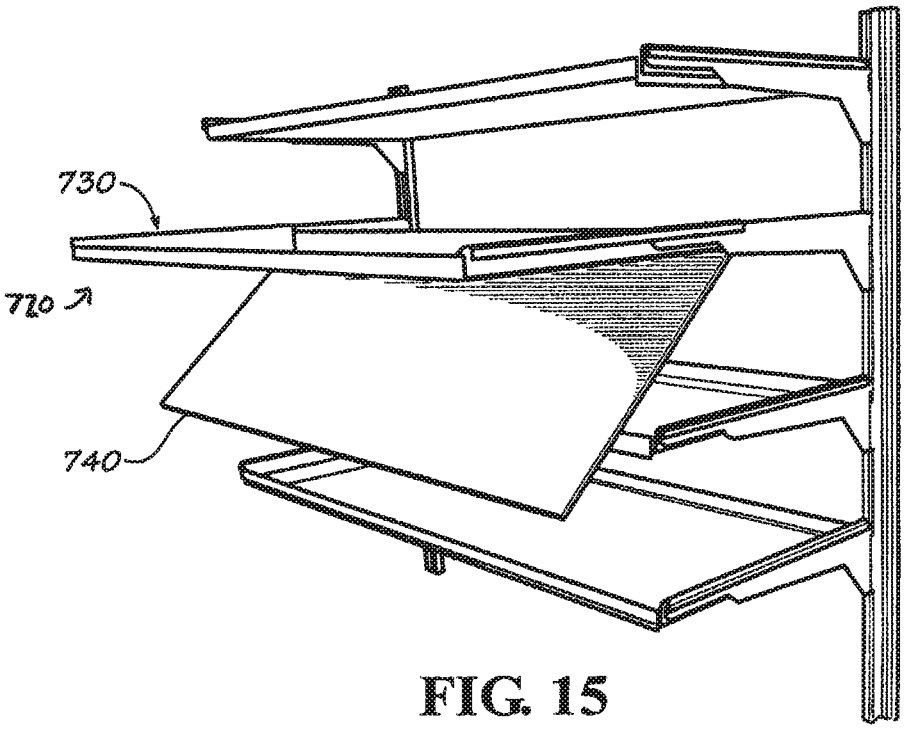
FIG. 15 is a perspective view of a drop out shelf as may be described herein.

Other product variations include slide out product shelves 690. As is shown in, for example, FIGS. 13 and 14, the shelf panel 650 may have a number of panel rollers 700 that fit within an outer rail slot 710. The slide out shelves690 thus may allow the shelf panel 650 to maneuver within the outer rail slots 710 for ease of stocking and ease of cleaning A further alternative is the drop out shelf 720 of FIG. 15. In the case of the use of a perforated shelf panel 730, a lower panel 740 may be maneuverable such that the lower pane1740 may flip down so as to clean any collected debris and/or liquids. Other components and other configurations may be used herein.

Figure 16:
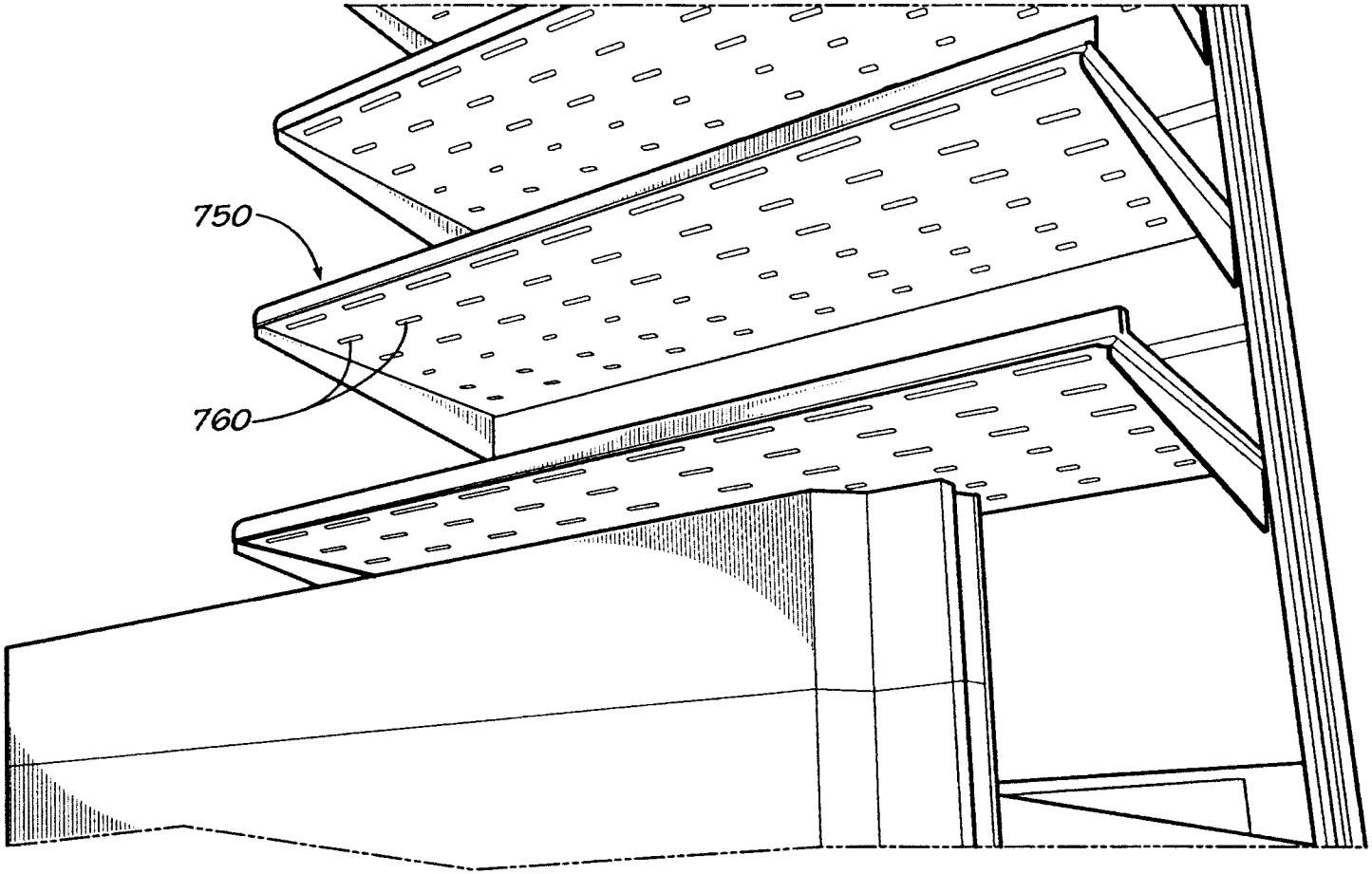
FIG. 16 is a perspective view of a micro-climate shelf as may be described herein.
Figure 17:
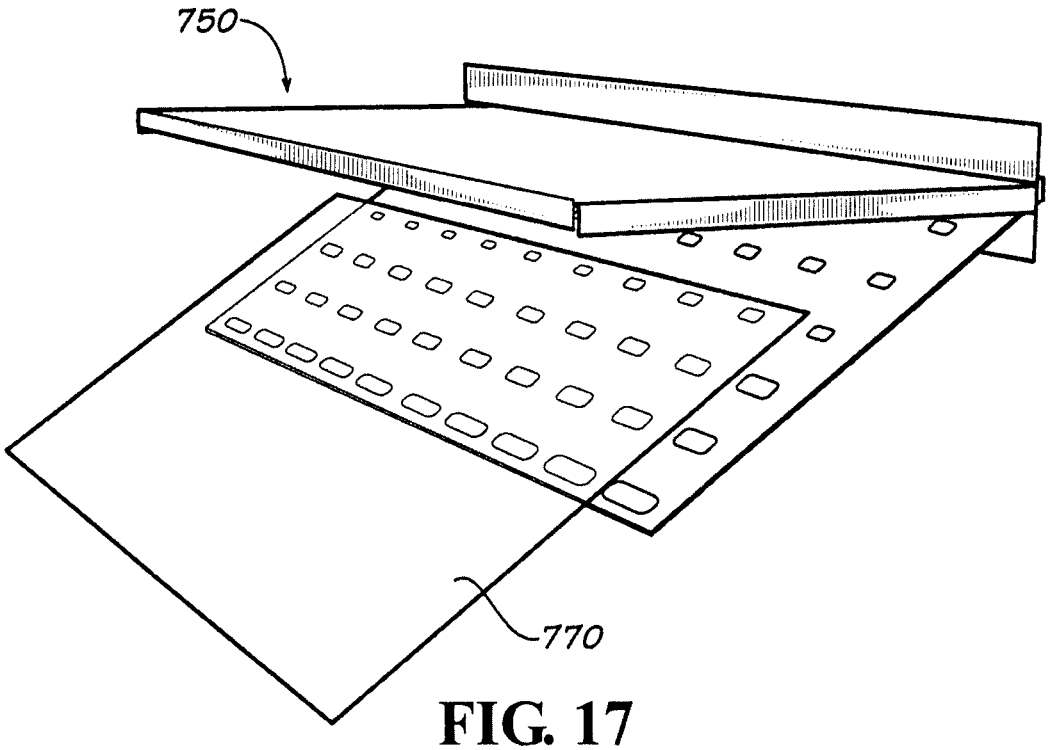
FIG. 17 is a perspective view of ethylene filter shelf as may be described herein.

A further embodiment is a microclimate shelf 750 as is shown in FIG. 16. The microclimate shelf 750 may have a number of air slots 760 in communication with the air plenums 310. The use of the air slots 760 thus allows air to be distributed through the microclimate shelf 750 and over the products below. Moreover, as is shown in FIG. 17, an ethylene filter 770 also may be used to absorb ethylene gas so as to assist in keeping produce fresh. Other components and other configurations also may be used herein.

Figure 18:
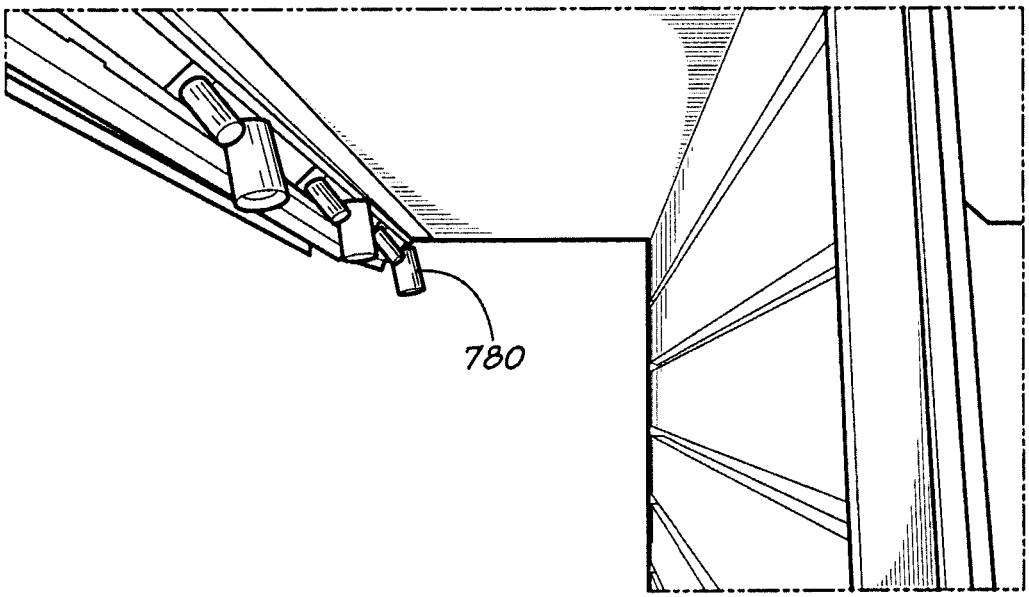
FIG. 18 is a perspective view of a refrigerated merchandising case with a track light.
Figure 19:
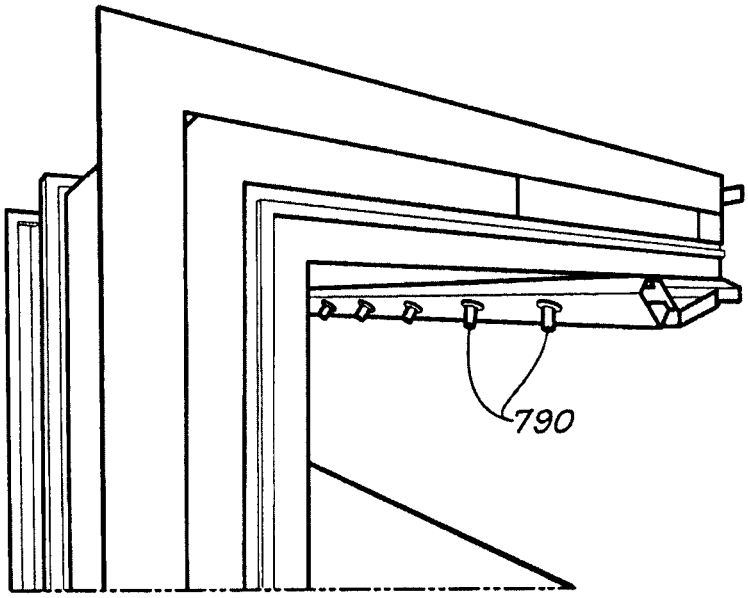
FIG. 19 is a perspective view of a refrigerated merchandising case with a mister.
Figure 20:
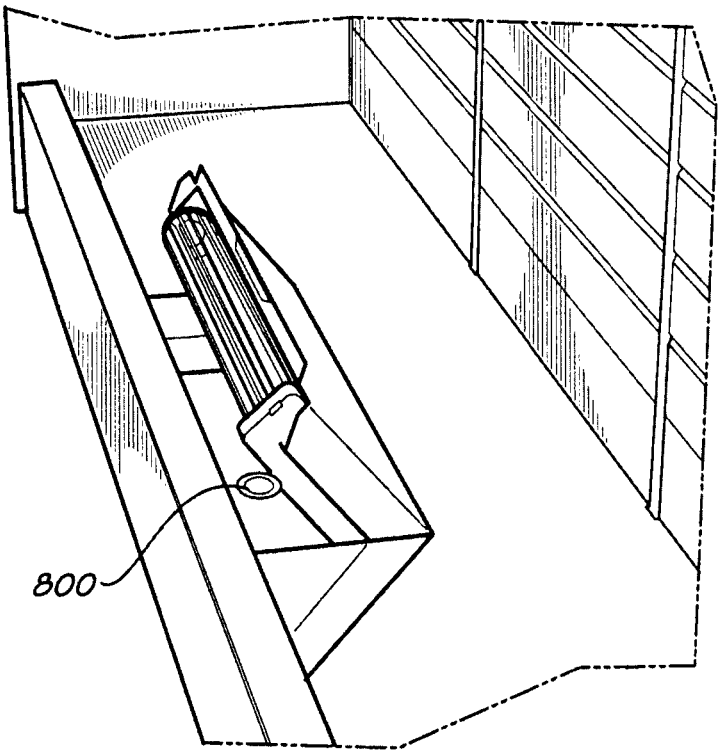
FIG. 20 is a perspective view of a refrigerated merchandising case with a cooling module with touch point indicators.
Figure 21:
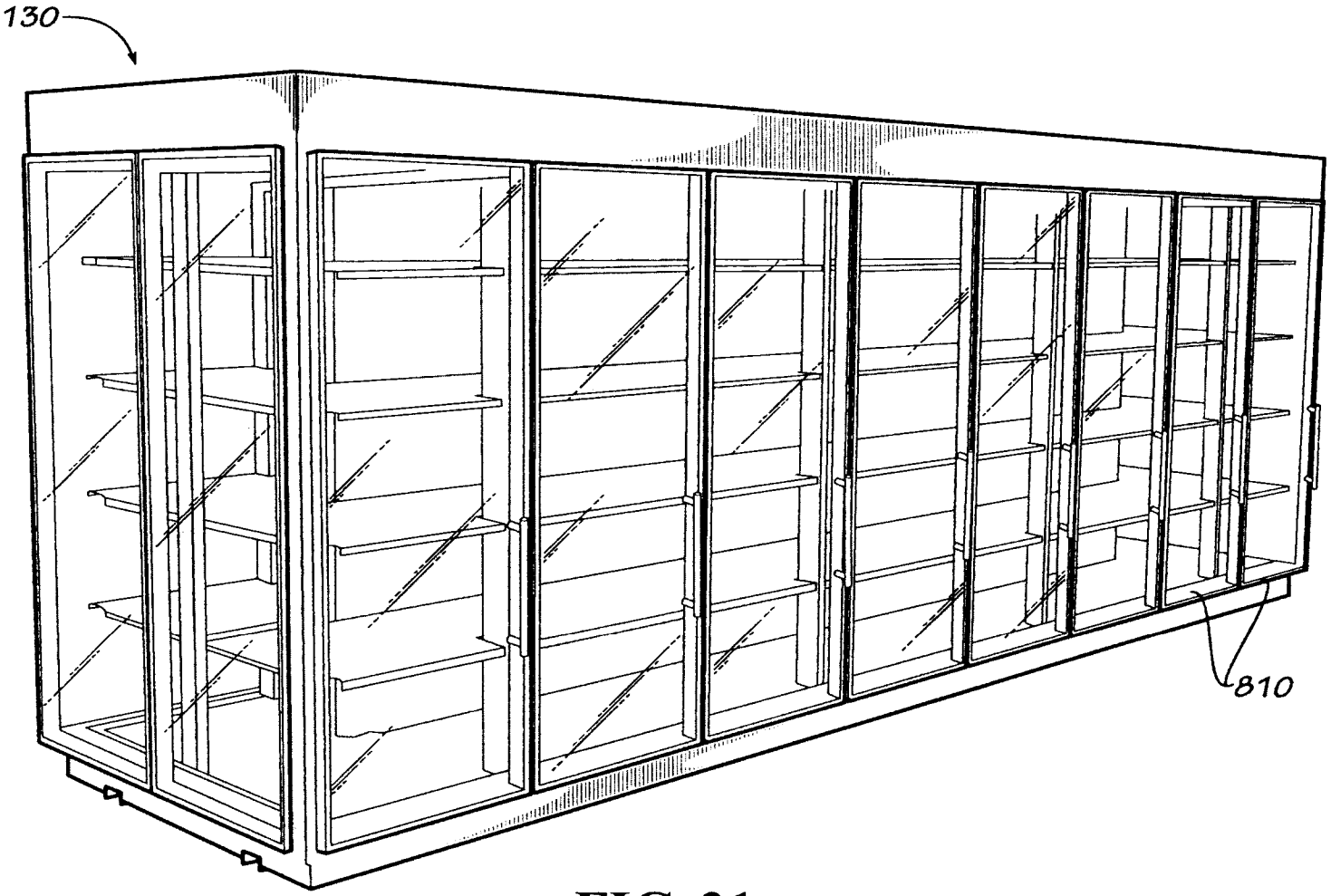
FIG. 21 is perspective view of a reach-in refrigerated merchandising case as may be described herein.
Figure 22:
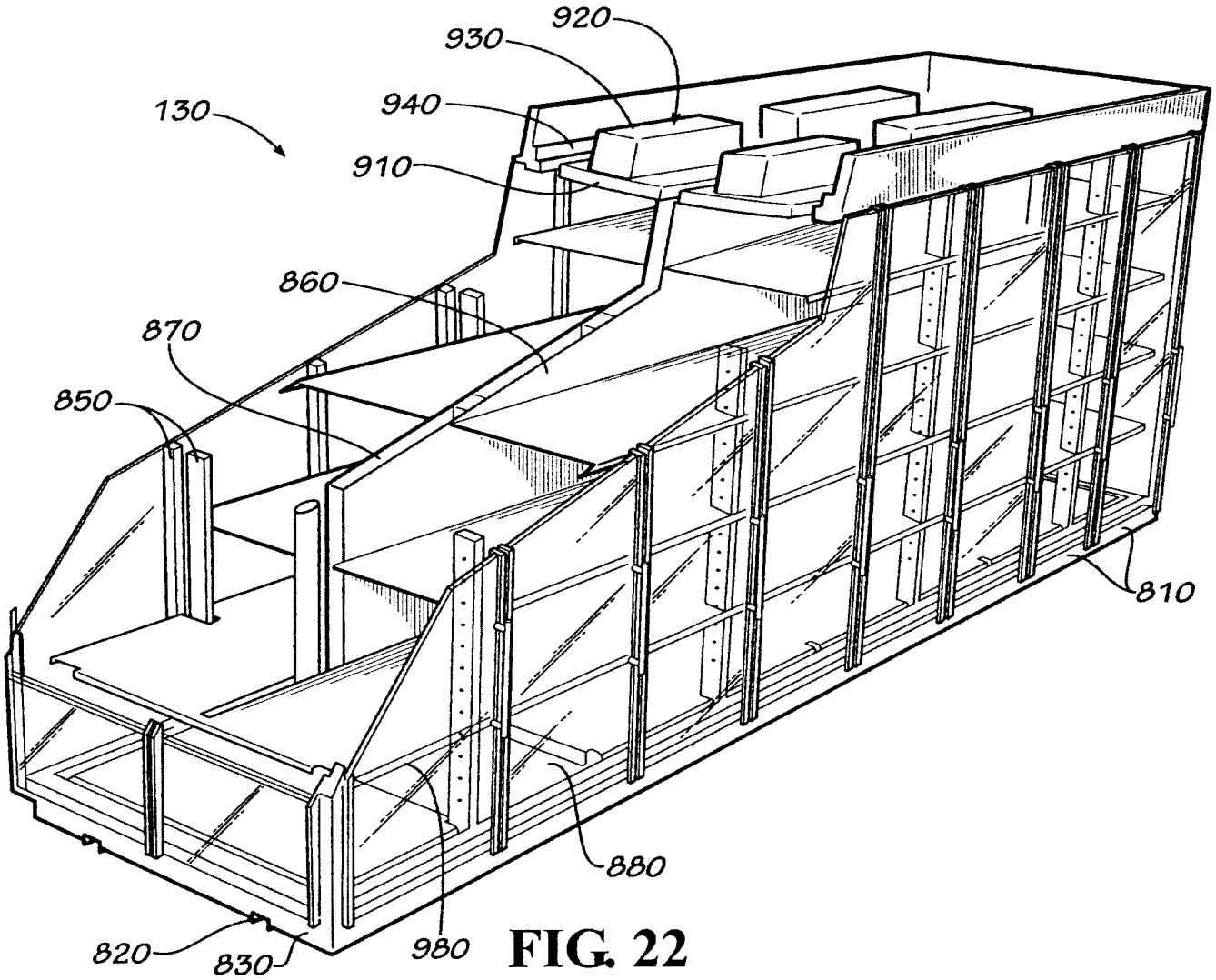
FIG. 22 is a cutaway perspective view of the reach-in refrigerated merchandising case of FIG. 21.
Figure 23:
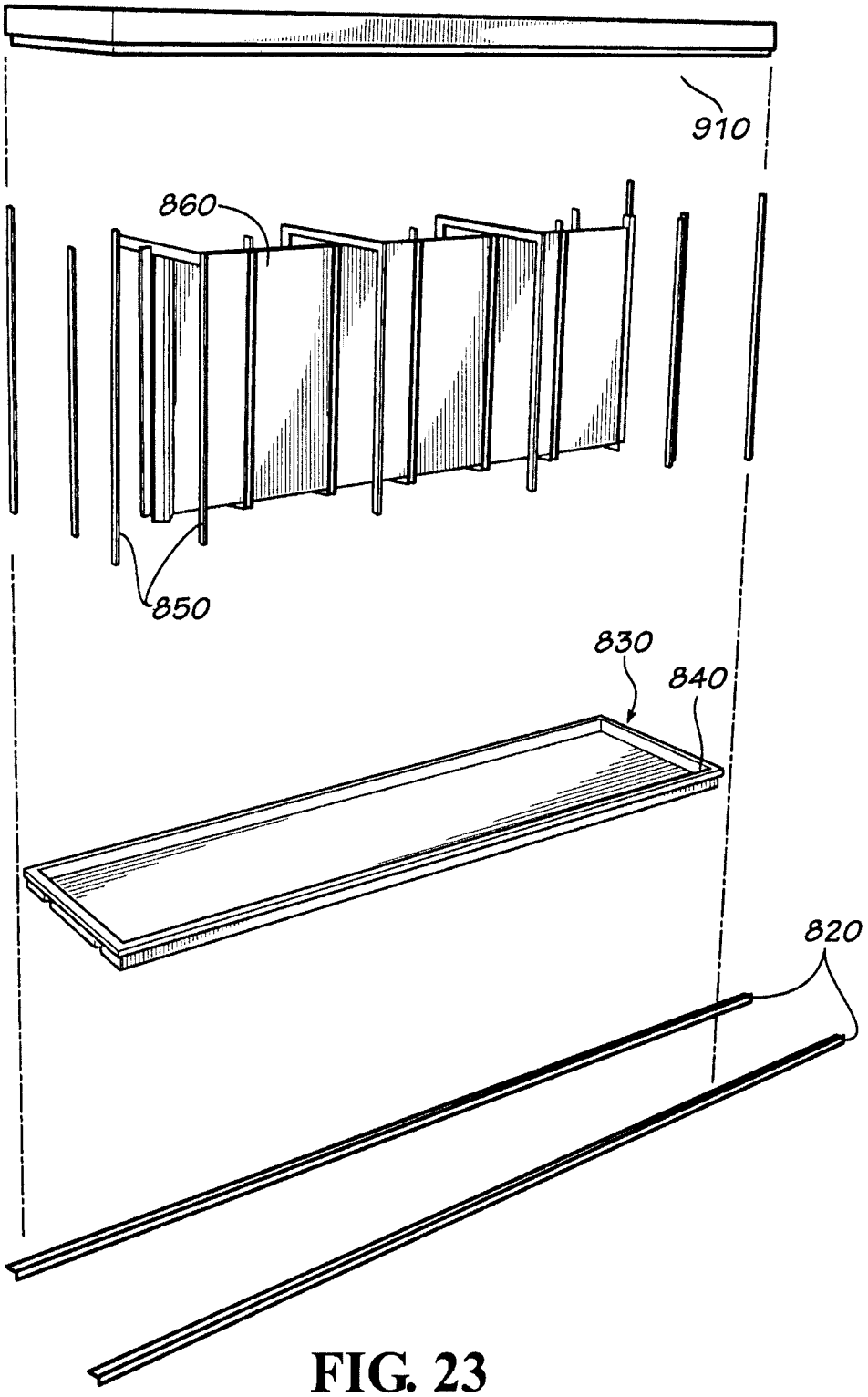
FIG. 23 is a partial exploded view of the reach-in refrigerated merchandising case of FIG. 21.

Other alternatives for use with the multi-deck refrigerated merchandising case 120 and other types of refrigerated merchandising cases 110 may include the use of track lighting 780 as is shown in FIG. 18, the use of misters 790 as shown in FIG. 19, and the use of touch point indicators 800 as shown in FIG. 20. With the touch point indicators 800, color indicators may provide direction and location of serviceable items. Other components and other configurations may be used herein.

The multi-deck refrigerated merchandising case 120 thus provides the modular components described herein for increased variety and flexibility with simplified assembly. Such flexibility may provide ease of stocking, cleanabilty as well as ease of access for maintenance and repair. Any number of different case configurations may be used herein.

FIGS. 21-28 show an example of a reach-in refrigerated merchandising case 130 as may be described herein. The reach-in refrigerated merchandising case 130 also may be modular and may extend to any suitable length. The reach-in refrigerated merchandising case 130 may be surrounded in whole or in part by any number of glass doors 810 so as to create a "glass box" like appearance.

Starting from the ground up, the reach-in refrigerated merchandising case 130 may be positioned on a number of rails 820. The rails 820 may be leveled with a number of shims and the like so as to accommodate any type of non-uniformity in the floor of the supermarket 100 or elsewhere. The rails 820 may be leveled using laser techniques and the like. The rails 820 may have any size, shape, or configuration. The rails 820 may be made out of steel or similar types of substantially rigid materials. An insulated base 830 may be positioned on the rails 820. The base 830 may have an outer flange 840 so as to collect condensate and the like therein. The base 830 may have any size, shape, or configuration.

Figure 24:
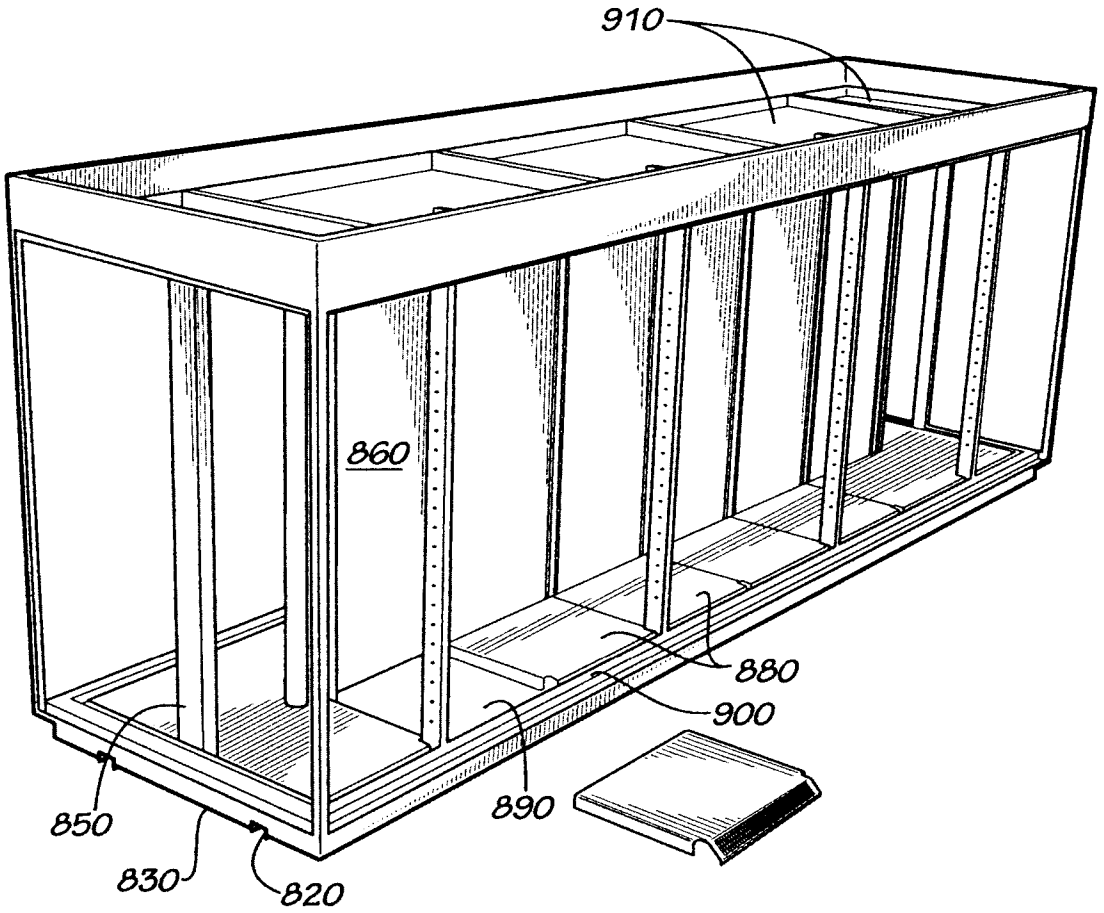
FIG. 24 is a partial perspective view of the reach-in refrigerated merchandising case of FIG. 21.

The reach-in refrigerated merchandising case 130 may include a number of frame members 850. Any number of the frame members 850 may be used in any size, shape, or configuration. The frame members 850 may be largely U-shaped and/or straight members. A number of vertical sheet metal panels 860 may form one or more inner air plenums 870. The panels 860 and inner air plenums 870 may have any size, shape, or configuration. A number of deck pans 880 may be positioned within the base 830 and in communication with the inner air plenum 870. The deck pans 880 may form a lower plenum 890 in communication with the inner air plenum 870. As is shown in FIG. 24, the deck pans 880 may include a number of pan apertures 900. The pan apertures 900 may permit a flow of air to pass therethrough and create an air curtain effect in front of the glass doors 810 or elsewhere. The deck pans 880 and the pan apertures 900 may have any size, shape, or configuration.

Figure 25A:
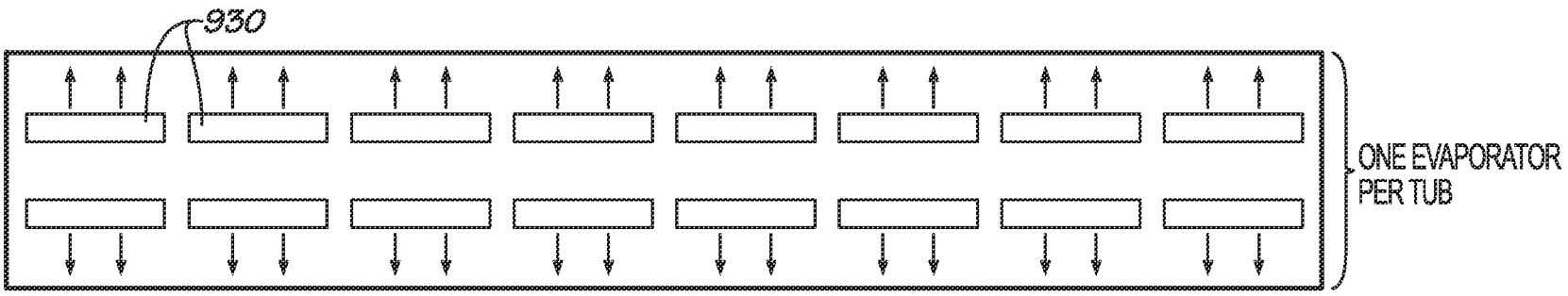
FIG. 25A is a schematic diagram of a cooling scheme for use with the reach-in refrigerated merchandising case of FIG. 21.
Figure 25B:
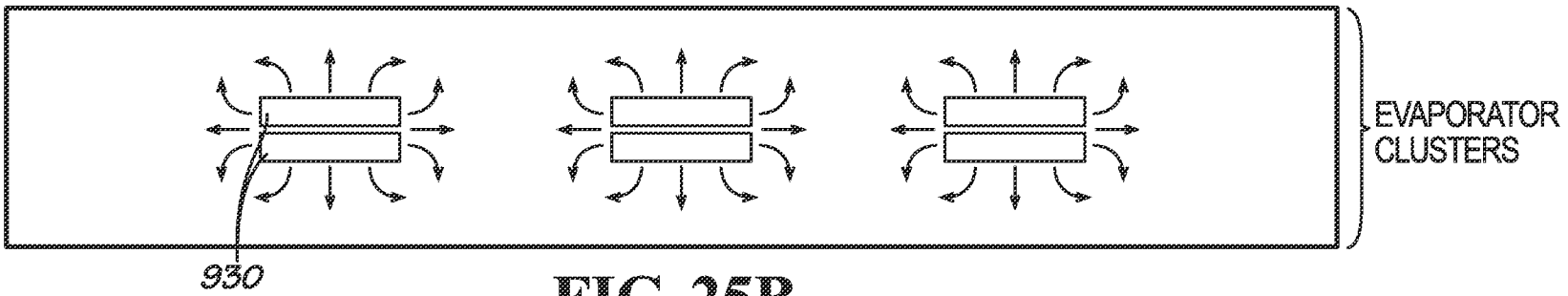
FIG. 25B is a schematic diagram of an alternative cooling scheme for the reach-in refrigerated merchandising case of FIG. 21.
Figure 25C:
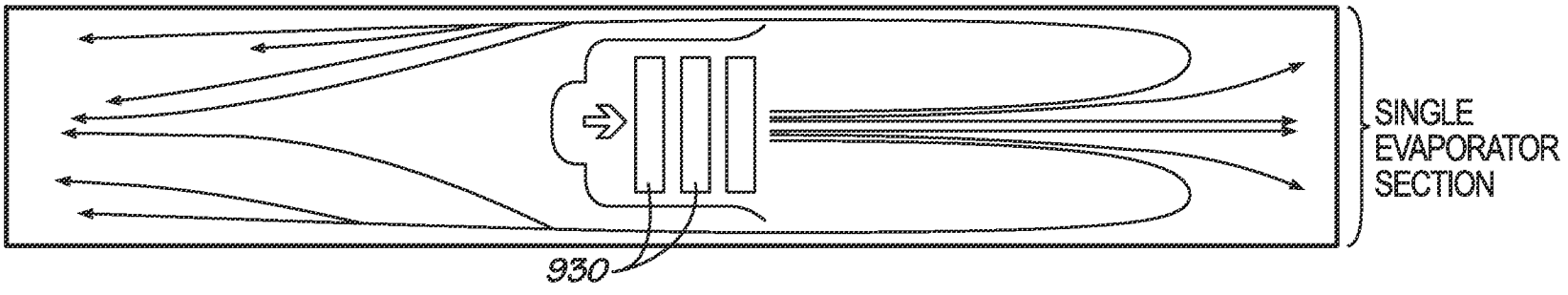
FIG. 25C is a schematic diagram of an alternative cooling scheme for the reach-in refrigerated merchandising case of FIG. 21.
Figure 26:
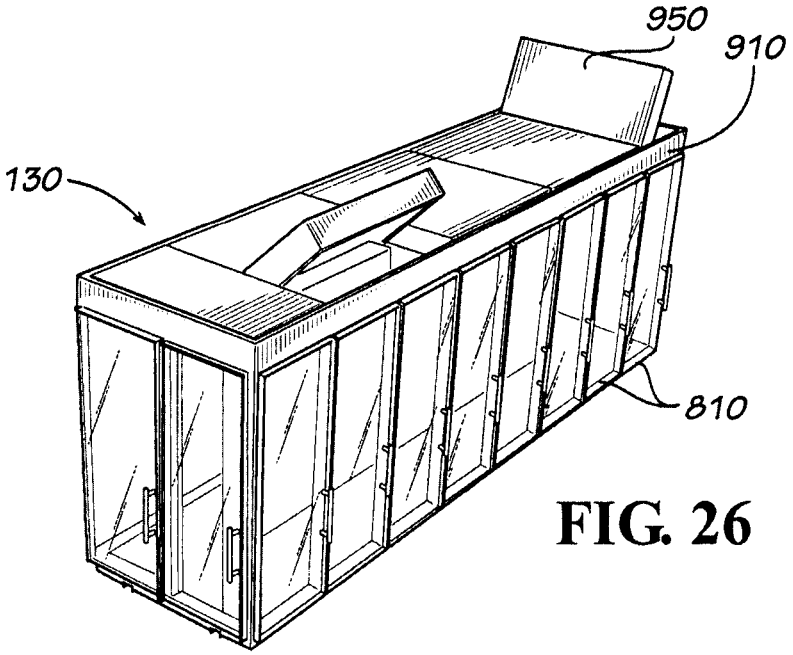
FIG. 26 is a partial perspective view of the reach-in refrigerated merchandising container of FIG. 21.

The reach-in refrigerated merchandising container 130 may be enclosed by a number of ceiling panels 910. The ceiling panels 910 may have any size, shape, or configuration. A number of cooling modules 920 may be positioned on the ceiling panels 910. The cooling modules 920 may include a number of evaporator coils 930 positioned within a drain pan 940. The evaporator coils 930 and the cooling modules 920 as a whole may have any size, shape, or configuration and/or capacity. The evaporator coils 930 may be in communication with the inner air plenum 870 and the lower plenum 890 so as to circulate a flow of cooling air throughout the reach-in refrigerated merchandising case 130. As is shown in FIGS. 25A-25C, the cooling modules 920 may have a number of different configurations. As is shown in FIG. 25A, each cooling module 920 may have one set of evaporator coils 930. Alternatively as is shown in FIG. 25B, a number of evaporator clusters may be used. As shown in FIG. 25C, a single evaporator section also may be used. Other types of evaporator configurations may be used herein. As is shown in FIG. 26, the ceiling panels 910 may be enclosed by an insulated coil cover 950 or other structure. The insulated coil covers 950 may be hinged so as to allow easy access. Any number of the coil covers 950 may be used herein in any size, shape, or configuration. Other components and other configurations may be used herein.

Figure 27:
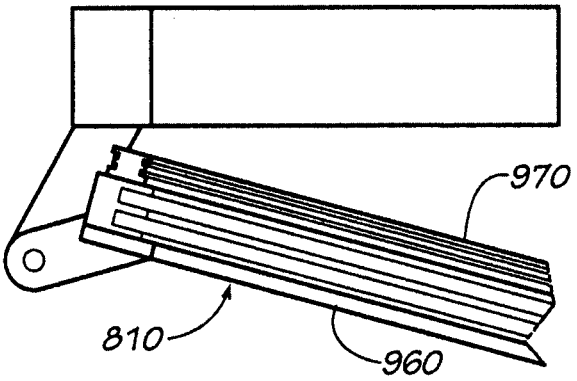
FIG. 27 is a partial plan view of a door that may be used with the reach-in refrigerated merchandising case of FIG. 21.

As is shown in FIG. 27, each glass door 810 may include a glass panel 960 and a door frame 970. Any number of the glass doors 810 may be used herein in any size, shape, or configuration. The glass panel 960 may be made out of any type of insulated, transparent materials. The glass panel 960 may extend somewhat beyond the door frame 970 so as to give the illusion that the door frame 970 do not exist. Such positioning may increase the "glass box" like appearance of the reach-in refrigerated merchandising case 130 as a whole. Other components and other configurations may be used herein.

Figure 28:
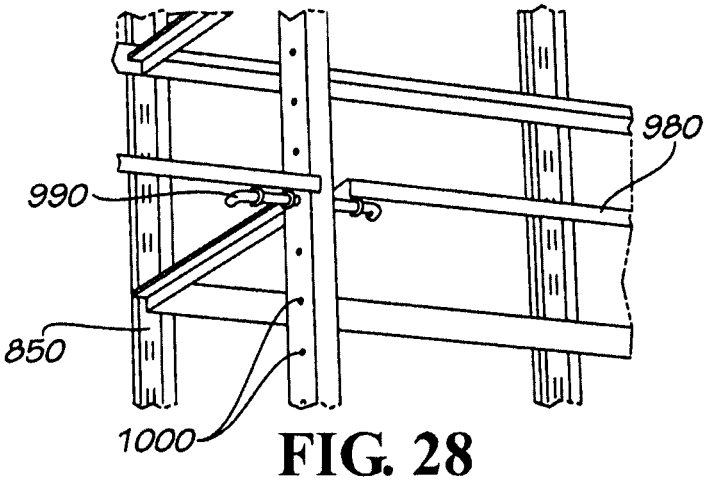
FIG. 28 is a partial perspective view of the shelving for use in the reach-in refrigerated merchandising case of FIG. 21.

As is shown in FIG. 28, a number of shelves 980 may be positioned within the reach-in refrigerated merchandising case 130. The shelves 980 may be attached to the frame members 850 by a number of quick disconnect pins 990. The quick disconnect pins 990 may fit within a number of frame apertures 1000 in the frame members 850. The absence of traditional shelf brackets may increase overall visibility and allow space for more products therein. Other types of shelving may be used herein. Other components and other configurations may be used herein.

The reach-in refrigerated merchandising case 130 thus provides increased and improved visibility given the use of the surrounding glass surfaces. Moreover, moving the cooling modules 970 to the ceiling panels 910 allows more product to be positioned therein and for the product to be more accessible as compared to traditional equipment with the refrigeration equipment generally positioned about the base thereof. The components described herein also may be used in other types of refrigerated merchandising cases 110 and the like.

Figure 29:
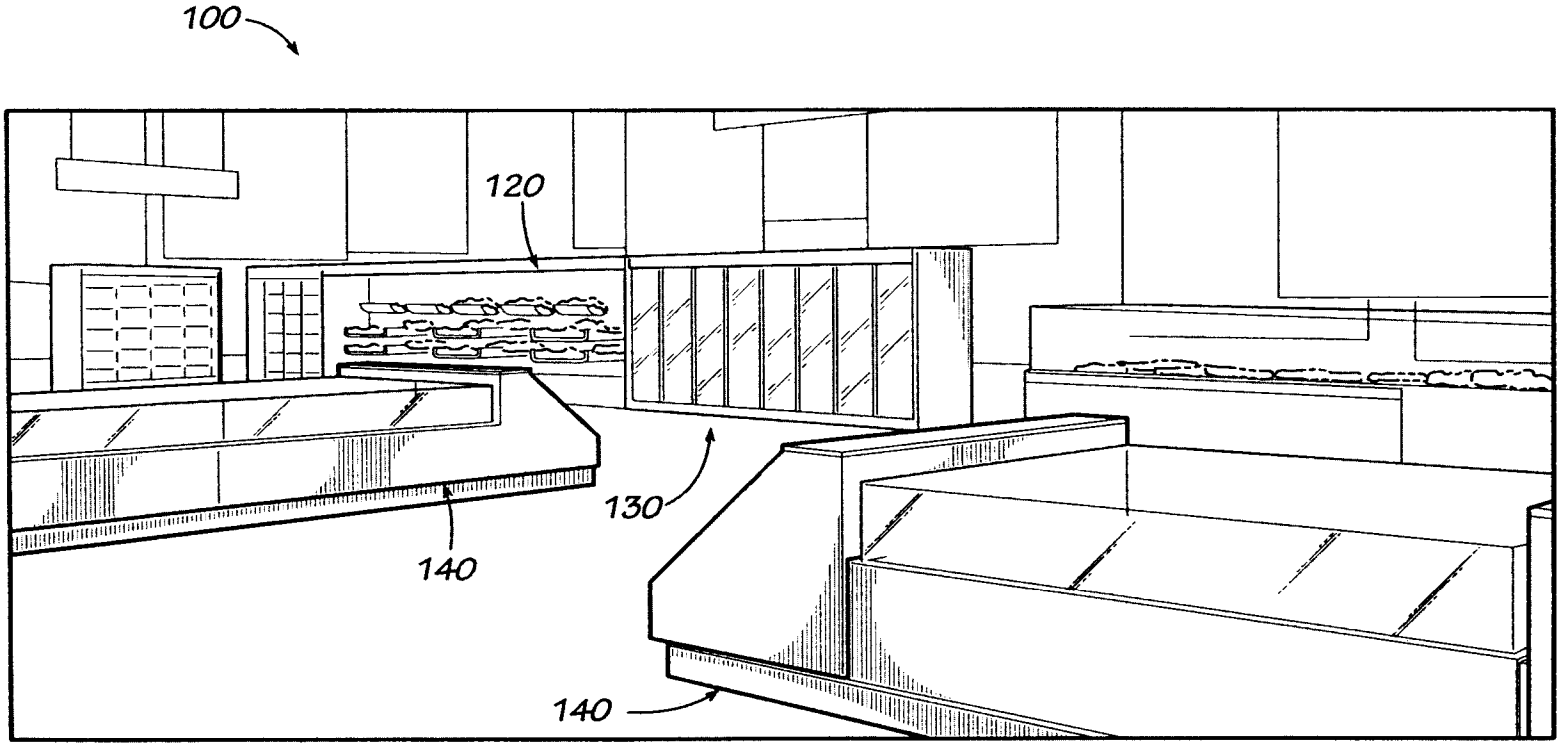
FIG. 29 is a perspective view of various types of refrigerated merchandising cases positioned in the supermarket as may be described herein.
Figure 30:
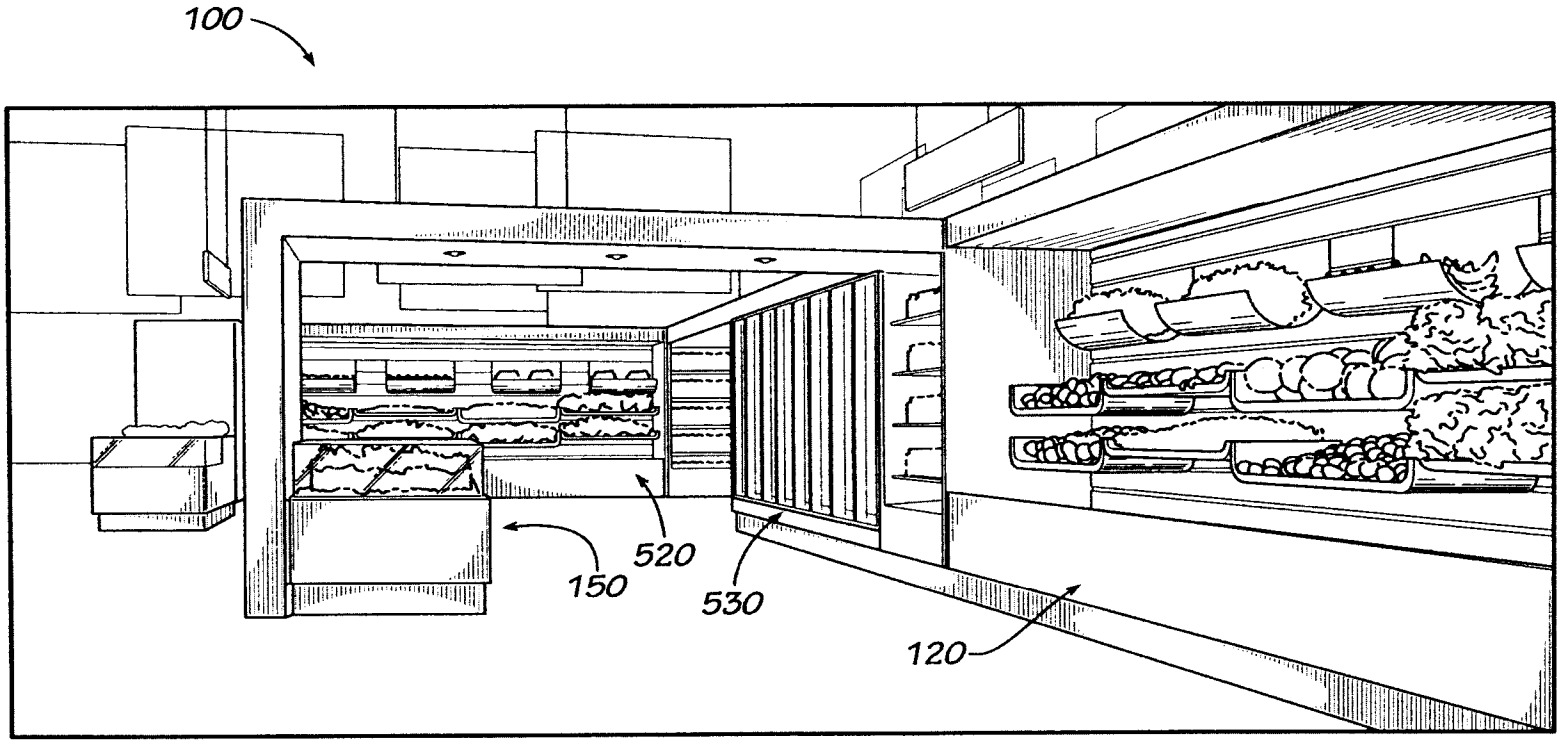
FIG. 30 is a further perspective view of the refrigerated merchandising cases.

FIGS. 29 and 30 show various types of refrigerated merchandising cases 110 positioned in an example of the supermarket 100. As is shown, the refrigerated merchandising cases 110 may include the use of the multi-deck refrigerated merchandising cases 120, the reach-in refrigerated merchandising cases 130, the island refrigerated merchandising cases 140, the single-deck refrigerated merchandising cases 150, as well as the service refrigerated merchandising cases 520. As is shown, each of the refrigerated merchandising cases 110 may have differing sizes, shapes, and configurations based, at least in part, on the products therein. Many other configurations may be used herein.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof

We claim:

1. A refrigerated merchandising case, comprising:

a tub, the tub comprising a pair of gussets extending upwardly therefrom;

an evaporator positioned within the tub;

a rear panel extending upwardly from the tub;

the rear panel comprising a shell and a pair of gusset channels, each gusset channel receiving a respective gusset of the pair of gussets, the rear panel comprising a panel channel;

a slat wall received within the panel channel of the rear panel, the slat wall comprising a plurality of support channels formed therein, the plurality of support channels comprising an angled entrance and a vertical portion leading to an enclosed end, wherein the shell of the rear panel and the slat wall define a unitary air plenum, the unitary air plenum being a single vertical air passage, wherein the evaporator is configured to provide air to the single vertical air passage of the unitary air plenum;

a plurality of shelves, each shelf comprising a shelf surface, an angled support bracket, and a mounting flange disposed perpendicular to the shelf surf ace, the mounting flange being received into a corresponding angled entrance and the vertical portion of a support channel of the plurality of support channels, the angled support bracket having a tapered profile and comprising a first end disposed proximate a distal end of the shelf surf ace and a second end disposed proximate a proximal end of the shelf surf ace such that the second end rests in flush contact with the slat wall when the shelf is assembled to the slat wall, the angled support bracket supports the shelf surf ace; and a top panel extending from the rear panel.

2. The refrigerated merchandising case of claim 1, wherein the refrigerated merchandising case comprises a multi-deck refrigerated merchandising case.

3. The refrigerated merchandising case of claim 1, further comprising a foundation supporting the tub and the rear panel.

4. The refrigerated merchandising case of claim 3, wherein the rear panel is attached to the foundation via the pair of gussets.

5. The refrigerated merchandising case of claim 1, wherein the tub comprises a plurality of thermoplastic sides and a metal bottom.

6. The refrigerated merchandising case of claim 1, wherein the rear panel comprises a foam interior.

7. The refrigerated merchandising case of claim 1, comprising an inner lower panel received into the panel channel, the inner lower panel comprising a plurality of inlet openings in communication with the air plenum.

8. The refrigerated merchandising case of claim 1, wherein each shelf of the plurality of shelves comprises an ethylene filter.

9. The refrigerated merchandising case of claim 1, wherein the air plenum continues into the top panel.

10. The refrigerated merchandising case of claim 1, wherein the top panel comprises a honeycomb module in communication with the air plenum.

11. The refrigerated merchandising case of claim 1, further comprising a mister therein.

12. A multideck refrigerated merchandising case, comprising:

a tub, the tub comprising a pair of gussets extending upwardly therefrom;

an evaporator positioned within the tub;

a unitary rear panel extending from the tub;

the rear panel comprising a shell, a foam interior, and a pair of gusset channels, each gusset channel receiving a respective gusset of the pair of gussets, the rear panel comprising a panel channel;

a slat wall received within the panel channel of the rear panel, the slat wall comprising a plurality of support channels formed therein, the plurality of support channels comprising an angled entrance and a vertical portion leading to an enclosed end, wherein the shell of the rear panel and the slat wall define a unitary air plenum, the unitary air plenum being a single vertical air passage, wherein the evaporator is configured to provide air to the single vertical air passage of the unitary air plenum;

a plurality of shelves, each shelf comprising a shelf surface, an angled support bracket, and a mounting flange disposed perpendicular to the shelf surf ace, the mounting flange being received into a corresponding angled entrance and the vertical portion of a support channel of the plurality of support channels, the angled support bracket having a tapered profile and comprising a first end disposed proximate a distal end of the shelf surf ace and a second end disposed proximate a proximal end of the shelf surf ace such that the second end rests in flush contact with the slat wall when the shelf is assembled to the slat wall, the angled support bracket supports the shelf surf ace; and a top panel extending from the rear panel.

13. The multideck refrigerated merchandising case of claim 12, comprising an inner lower panel received into the panel channel, the inner lower panel comprising a plurality of inlet openings in communication with the air plenum.

14. The multideck refrigerated merchandising case of claim 12, wherein the air plenum continues into the top panel.

* * * * *